US009682547B2

(12) United States Patent
Yamagishi

(10) Patent No.: US 9,682,547 B2
(45) Date of Patent: Jun. 20, 2017

(54) LIQUID EJECTING APPARATUS AND METHOD OF CONTROLLING LIQUID EJECTING APPARATUS

(71) Applicant: SEIKO EPSON CORPORATION, Tokyo (JP)

(72) Inventor: Ken Yamagishi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/826,915

(22) Filed: Aug. 14, 2015

(65) Prior Publication Data

US 2016/0046123 A1 Feb. 18, 2016

(30) Foreign Application Priority Data

Aug. 18, 2014 (JP) ..... 2014-166232
Aug. 18, 2014 (JP) ..... 2014-166233

(51) Int. Cl.
*B41J 2/045* (2006.01)

(52) U.S. Cl.
CPC ..... *B41J 2/04551* (2013.01); *B41J 2/04581* (2013.01)

(58) Field of Classification Search
CPC ..... B41J 2/165; B41J 2/04551; B41J 2/04851
See application file for complete search history.

(56) References Cited

U.S. PATENT DOCUMENTS

2009/0066747 A1* 3/2009 Hays ..... B41J 2/16517 347/23
2015/0352853 A1* 12/2015 Kudo ..... B41J 2/175 347/86

FOREIGN PATENT DOCUMENTS

JP 07-329297 A 12/1995
JP 3677771 B2 5/2005
JP 2009-061779 A 3/2009

* cited by examiner

*Primary Examiner* — Sarah Al Hashimi
(74) *Attorney, Agent, or Firm* — Workman Nydegger

(57) ABSTRACT

A liquid ejecting apparatus includes: a pressure generating chamber which is used for discharging a liquid in the pressure generating chamber through a nozzle by driving a driving element; a manifold which supplies a liquid to the pressure generating chamber; a discharge unit which discharges a liquid in the pressure generating chamber through the nozzle. Mode 1 is a mode in which air is drawn into the pressure generating chamber through the nozzle due to the operation of the discharge unit, and Mode 2 is a mode which drives the driving element such that air is not drawn into the pressure generating chamber through the nozzle due to the driving of the driving element.

20 Claims, 12 Drawing Sheets

LIQUID EJECTING APPARATUS AND METHOD OF CONTROLLING LIQUID EJECTING APPARATUS

CROSS-REFERENCE TO RELATED APPLICATIONS

This application claims priority to Japanese Patent Application No. 2014-166232 filed on Aug. 18, 2014 and Japanese Patent Application No. 2014-166233 filed on Aug. 18, 2014. The entire disclosures of Japanese Patent Application Nos. 2014-166232 and 2014-166233 are hereby incorporated herein by reference.

BACKGROUND

1. Technical Field

The present invention relates to a liquid ejecting apparatus which is provided with a liquid ejecting head that ejects a liquid from a nozzle opening, and particularly to an ink jet recording apparatus which is provided with an ink jet recording head that discharges an ink as a liquid, and to a method of controlling the liquid ejecting apparatus.

2. Related Art

As a liquid ejecting apparatus which ejects a liquid on a medium to be ejected, for example, an ink jet recording apparatus has been known which performs printing on a medium, to be recorded, such as paper or a recording sheet, that is, a medium to be ejected, by ejecting an ink as a liquid.

An ink jet recording head which is mounted on such an ink jet recording apparatus has a problem in that in a case where an ink in a pressure generating chamber freezes and is expanded, if there is no space for ink to escape in the pressure generating chamber, cracking is caused in the pressure generating chamber, in particular, on a vibrating plate.

A liquid ejecting apparatus has been proposed (for example, refer to JP-A-2009-61779) which empties the inside of the pressure generating chamber by making an ink flow back to a reservoir side from the pressure generating chamber before freezing in a case where the ink is likely to freeze.

However, in the above-described apparatus, a pump is required which may increase the negative pressure on the reservoir in order to make the ink flow back to the reservoir, and therefore, there are problems in that the size of the apparatus may be increased and the apparatus may become complicated.

Similarly, such problems also exist in a liquid ejecting apparatus which ejects a liquid other than an ink as well as in the ink jet recording apparatus.

SUMMARY

An advantage of some aspects of the invention is to provide a liquid ejecting apparatus which can prevent generation of cracks in a pressure generating chamber due to expansion of a liquid while the liquid freezes, and a method of controlling the liquid ejecting apparatus.

Aspect 1

According to an aspect of the invention, there is provided a liquid ejecting apparatus including: a pressure generating chamber which communicates with a nozzle and is used for discharging a liquid in the pressure generating chamber through the nozzle through pressure fluctuation caused by driving a driving element; a manifold which communicates with the pressure generating chamber and supplies a liquid to the pressure generating chamber; a discharge unit which discharges a liquid in the pressure generating chamber through the nozzle; and a control unit which can discharge a liquid through the nozzle by selecting Mode 1 or Mode 2. Mode 1 is a mode in which a liquid in the pressure generating chamber is discharged through the nozzle such that air is drawn into the pressure generating chamber through the nozzle due to the operation of the discharge unit, and Mode 2 is a mode in which the driving element is driven such that air is not drawn into the pressure generating chamber through the nozzle due to the driving of the driving element.

In the aspect, it is possible to introduce air into the pressure generating chamber through the nozzle through Mode 1. For this reason, it is possible to remove or reduce the liquid which freezes and to prevent cracking in the pressure generating chamber even if the temperature reaches a temperature at which the liquid after the removal or the reduction freezes.

Aspect 2

Here, in the liquid ejecting apparatus according to the aspect 1, it is preferable that the nozzle include a first nozzle and a second nozzle, and Mode 1 be a mode in which air is drawn into the manifold through the first nozzle, air is not drawn through the second nozzle, and the air in the manifold which is drawn through the first nozzle forms a meniscus in a flow path between the manifold and a pressure generating chamber which communicates with the second nozzle.

In the aspect, regarding the pressure generating chamber which communicates with the first nozzle, it is possible to remove or reduce the liquid which freezes, by drawing air into the pressure generating chamber. In addition, regarding the pressure generating chamber which communicates with the second nozzle, although a liquid remains in the pressure generating chamber, air exists in the flow path between the pressure generating chamber and the manifold. Therefore, it is possible to prevent cracking in the pressure generating chamber since there is a space for the liquid to escape due to expansion even if the liquid in the pressure generating chamber freezes and expands.

Aspect 3

In addition, in the liquid ejecting apparatus according to the aspect 1 or 2, it is preferable that the liquid ejecting apparatus further include: a blocking unit which blocks the flow path in the middle of the flow path through which a liquid is supplied to the manifold, and Mode 1 be performed in a state where the flow path is blocked by the blocking unit.

In the aspect, in Mode 1, even if the amount of a liquid discharged by the discharge unit is small, it is possible to effectively reduce the amount of a liquid supplied to the pressure generating chamber through the manifold by blocking the flow path and to effectively draw air by forming a negative pressure. Particularly, when the discharge unit is a driving element, even if the amount of the liquid discharged from the pressure generating chamber through a nozzle is small, it is possible to effectively reduce the amount of the liquid supplied to the pressure generating chamber through the manifold by blocking the flow path. Accordingly, it is possible to effectively satisfy the above-described relationship regardless of the discharge degree or the like of the discharge unit.

Aspect 4

Further, in the liquid ejecting apparatus according to any one of the aspects 1 to 3, it is preferable that the discharge unit be the driving element, and Mode 1 be a mode in which the driving element is driven such that air is drawn into the pressure generating chamber through the nozzle due to the driving of the driving element.

In the aspect, it is possible to realize each operation of Mode 1 and Mode 2 by driving the driving element, and therefore, it is possible to simplify control of the liquid ejecting apparatus.

Aspect 5

Further, in the liquid ejecting apparatus according to the aspect 4, it is preferable that the manifold communicate with a plurality of pressure generating chambers and supply a liquid to the plurality of pressure generating chambers, and Mode 1 be a mode in which the driving element is driven such that air is drawn into the manifold through the nozzle, through at least one pressure generating chamber among the plurality of pressure generating chambers, due to the driving of the driving element.

In the aspect, since air is drawn into the manifold and there are a plurality of pressure generating chambers, it is possible to set the manifold as a space for a liquid to escape from expansion of a liquid due to freezing even if air is not drawn into all of the pressure generating chambers, and therefore, it is possible to prevent cracking in the pressure generating chambers. Air may be drawn into all of the pressure generating chambers. However, the control in the above-described case is more simplified than the case in which air is drawn into all of the pressure generating chambers.

Aspect 6

Further, it is preferable that the period of a driving signal which drives the driving element in Mode 1 be shorter than that of a driving signal which drives the driving element in Mode 2.

In the aspect, it is possible to more effectively increase the amount of a liquid discharged from a pressure generating chamber through a nozzle by driving the driving element in the case of using Mode 1 in comparison to the case of Mode 2. Accordingly, it is possible to effectively draw air into the pressure generating chamber through the nozzle.

Aspect 7

Further, it is preferable that the amplitude of a driving signal which drives the driving element in Mode 1 be larger than that of a driving signal which drives the driving element in Mode 2.

In the aspect, it is possible to more effectively increase the amount of a liquid discharged from a pressure generating chamber through a nozzle by driving the driving element in the case of using Mode 1 in comparison to the case of Mode 2. Accordingly, it is possible to effectively draw air into the pressure generating chamber through the nozzle.

Aspect 8

Further, in the liquid ejecting apparatus according to any one of the aspects 1 to 7, it is preferable that the liquid ejecting apparatus further include: a maintenance unit which discharges air in the pressure generating chamber through the nozzle; and a movement unit which relatively moves a medium to be discharged and the nozzle, and that the control unit (1) operate the maintenance unit in Mode 3, (2) relatively move the medium to be discharged and the nozzle using the movement unit and drive the driving element such that air is not drawn into the pressure generating chamber through the nozzle due to the driving of the driving element, in Mode 2, and (3) Mode 2 be not performed until air in the pressure generating chamber is discharged in Mode 3 after drawing the air into the pressure generating chamber through the nozzle in Mode 1.

In the aspect, Mode 2 is not performed until Mode 3 is performed after Mode 1 is performed, and therefore, it is possible to prevent the result of discharging of a liquid to a medium to be discharged from being defective due to Mode 2.

Aspect 9

Further, in the liquid ejecting apparatus according to any one of the aspects 1 to 8, it is preferable that the control unit perform Mode 1 based on the selection by a user whether to perform Mode 1.

In the aspect, it is possible to make the execution of Mode 1 depend on the selection of a user at a timing at which Mode 1 may be executed, for example, during long-term preservation or commodity delivery, and therefore, the apparatus has high operability.

Aspect 10

Further, in the liquid ejecting apparatus according to any one of the aspects 1 to 8, it is preferable that the liquid ejecting apparatus further include: a detection unit which detects a temperature, and the control unit perform Mode 1 based on a detection result of the detection unit.

In the aspect, since it is possible to execute Mode 1 by detecting a timing when a liquid freezes, it is possible to perform Mode 1 even without the selection of a user, and therefore, the apparatus has high operability.

Aspect 11

According to another aspect of the invention, there is provided a method of controlling a liquid ejecting apparatus which includes a pressure generating chamber which communicates with a nozzle and is used for discharging a liquid in the pressure generating chamber through the nozzle through pressure fluctuation caused by driving of a driving element, a manifold which communicates with the pressure generating chamber and supplies a liquid to the pressure generating chamber, and a discharge unit which discharges a liquid in the pressure generating chamber through the nozzle, the method includes: controlling the apparatus so as to discharge a liquid through the nozzle by selecting Mode 1 or Mode 2. Mode 1 is a mode in which a liquid within the pressure generating chamber is discharged through the nozzle such that air is drawn into the pressure generating chamber through the nozzle due to operation of a discharge unit, and Mode 2 is a mode in which a driving element is driven such that air is not drawn into the pressure generating chamber through the nozzle due to the driving of the driving element.

In the aspect, it is possible to introduce air into the pressure generating chamber from the nozzle by Mode 1. For this reason, it is possible to remove or reduce the liquid which freezes and to prevent cracking in the pressure generating chamber even if the temperature reaches a temperature at which the liquid after the removal or the reduction freezes.

Aspect 12

According to a still another aspect of the invention, there is provided a liquid ejecting apparatus including: a nozzle plate in which a nozzle is formed; a pressure generating chamber which communicates with the nozzle and is used for discharging a liquid within the pressure generating chamber through the nozzle by pressure fluctuation caused by driving a driving element; a manifold which communicates with the pressure generating chamber and supplies a liquid to the pressure generating chamber; a cap unit for capping the nozzle; and a control unit which can operate the cap unit by selecting Mode 1 or 2. The region which is capped by the cap unit includes a region corresponding to at least a part of the manifold on a plane along the surface of the nozzle plate. Mode 1 is a mode in which the apparatus enters a power-off state or a power saving state in a state where the nozzle is not capped by the cap unit, and Mode 2 is a mode in which the apparatus enters a power-off state or a power saving state in a state where the nozzle is capped by the cap unit.

In the aspect, the apparatus enters a power-off state or a power saving state in a state where the nozzle is not capped, through Mode 1. Therefore, even if the temperature reaches a temperature at which the liquid freezes after the apparatus enters the power-off state or the power saving state, a liquid in the manifold does not freeze until liquids in the nozzle and the pressure generating chamber sequentially freeze, and there is a space for the liquid to escape due to an increase in the pressure caused by expansion of the pressure in the pressure generating chamber, and therefore, it is possible to prevent cracking in the pressure generating chamber.

Aspect 13

According to a still another aspect of the invention, there is provided a liquid ejecting apparatus including: a nozzle plate in which a nozzle is formed; a pressure generating chamber which communicates with the nozzle and is used for discharging a liquid within the pressure generating chamber through the nozzle through pressure fluctuation caused by driving of a driving element; a manifold which communicates with the pressure generating chamber and supplies a liquid to the pressure generating chamber; a cap unit for capping the nozzle; a movement mechanism which moves the nozzle relative to a medium to be discharged; a regulating unit which regulates the movement of the nozzle relative to the medium to be discharged; and a control unit which can operate the cap unit by selecting Mode 1 or 2. The region which is capped by the cap unit includes a region corresponding to at least a part of the manifold on a plane along the surface of the nozzle plate. Mode 1 is a mode in which the relative movement of the nozzle is regulated by the regulating unit in a state where the nozzle is not capped by the cap unit, and Mode 2 is a mode in which the relative movement of the nozzle is regulated by the regulating unit in a state where the nozzle is capped by the cap unit.

In the aspect, the movement relative to the cap of the nozzle is regulated by the regulating unit in a state where the nozzle is not capped, through Mode 1. Therefore, even if the temperature reaches a temperature at which the liquid freezes after the regulation of the movement, a liquid in the manifold does not freeze until liquids in the nozzle and the pressure generating chamber sequentially freeze, and there is a space for the liquid to escape due to an increase in the pressure caused by expansion of the pressure in the pressure generating chamber, and therefore, it is possible to prevent cracking in the pressure generating chamber. In addition, the relative movement can be prevented when moving or transporting the apparatus.

Aspect 14

Here, in the liquid ejecting apparatus according to the aspect 12 or 13, it is preferable that the liquid ejecting apparatus further include: a thermal insulation member which is fixed to a member that regulates the manifold. The thermal insulation member has a thermal conductivity which is lower than that of the nozzle plate.

In the aspect, the freezing of the liquid in the manifold is further delayed, and therefore, cracking in the pressure generating chamber can be more reliably prevented.

Aspect 15

In addition, in the liquid ejecting apparatus according to the aspect 14, it is preferable that the thermal insulation member have a multilayer structure which includes an air layer.

In the aspect, the freezing of the liquid in the manifold can be further reliably delayed, and therefore, the cracking in the pressure generating chamber can be more reliably prevented.

Aspect 16

Further, in the liquid ejecting apparatus according to any one of the aspects 12 to 15, it is preferable that the control unit perform Mode 1 based on the selection of a user of whether to perform Mode 1.

In the aspect, it is possible to make the execution of Mode 1 depend on the selection of a user at a timing at which Mode 1 may be executed, for example, during long-term preservation or commodity delivery, and therefore, the apparatus has high operability.

Aspect 17

Further, in the liquid ejecting apparatus according to any one of aspects 12 to 15, the liquid ejecting apparatus further include: a detection unit which detects a temperature. The control unit performs Mode 1 based on a detection result of the detection unit.

In the aspect, since it is possible to execute Mode 1 by detecting a timing when a liquid freezes, it is possible to perform Mode 1 even without the selection of a user, and therefore, the apparatus has high operability.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on embodiments.

Embodiment 1

Figure 1:
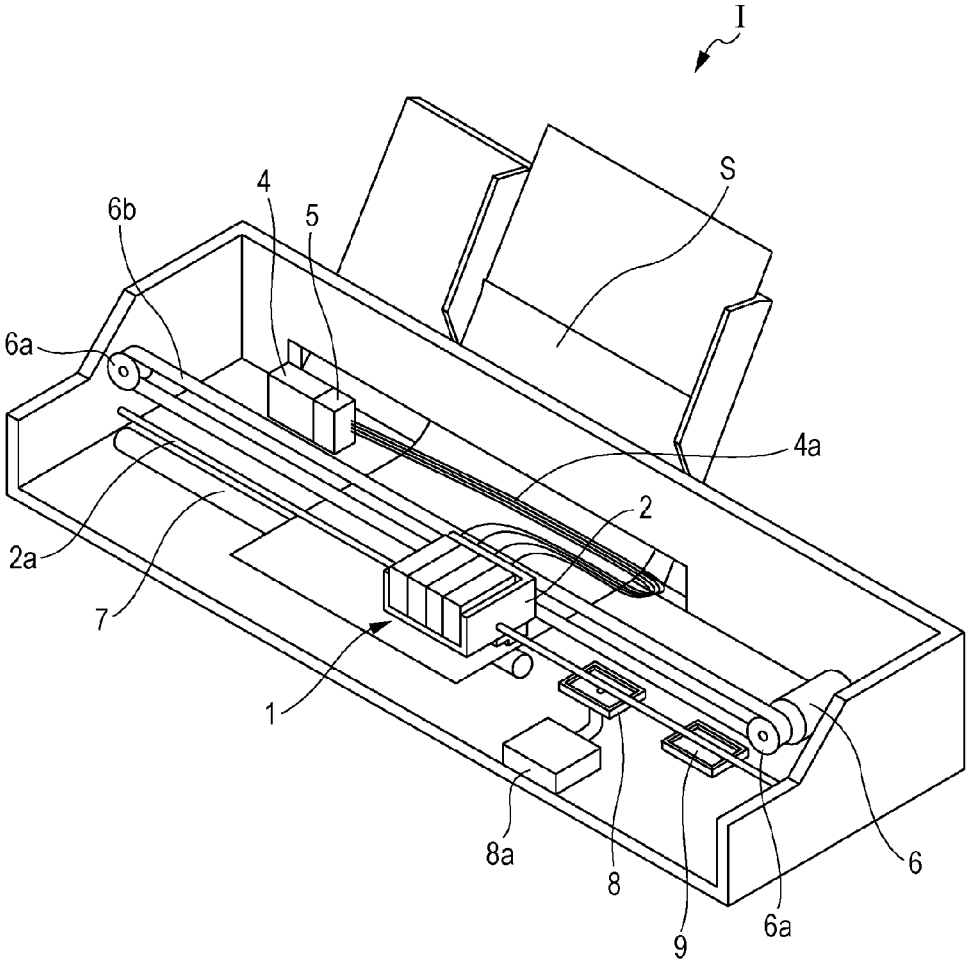
FIG. 1 is a schematic perspective view of a recording apparatus according to Embodiment 1 of the invention.
Figure 2:
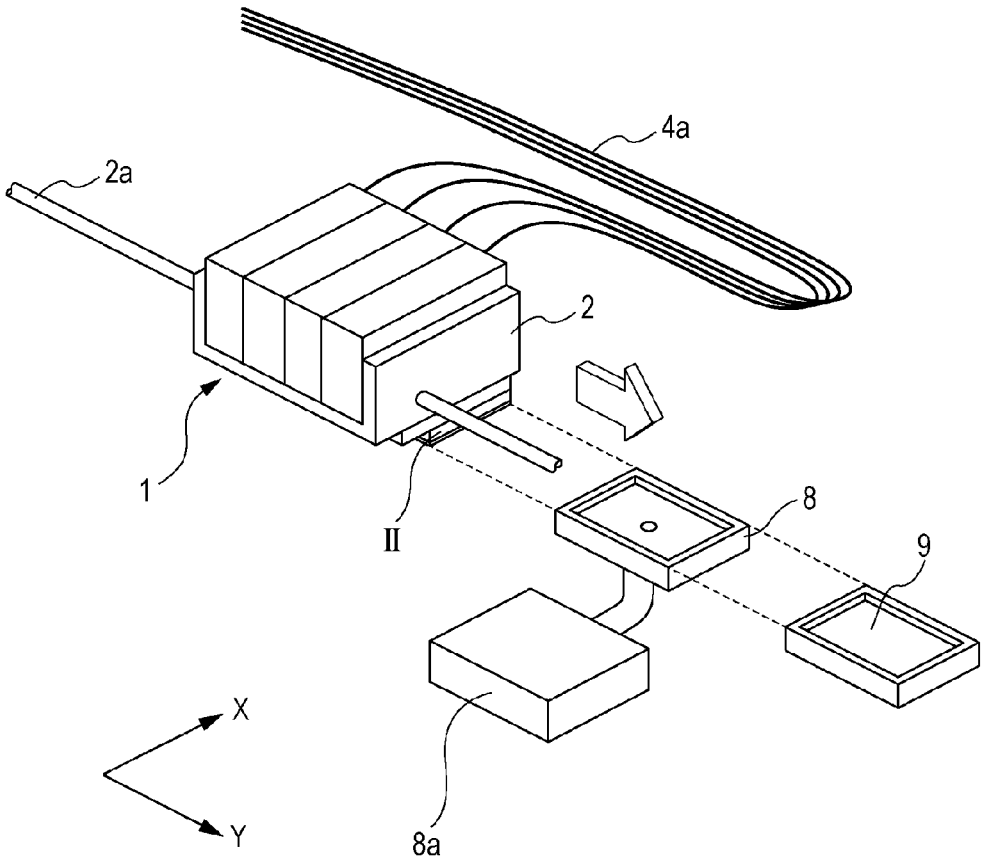
FIG. 2 is a schematic view for illustrating a cap of Embodiment 1.

FIG. 1 is a perspective view showing a schematic configuration of an ink jet recording apparatus which is an example of a liquid ejecting apparatus according to Embodiment 1 of the invention, and FIG. 2 is a perspective view showing a suction cap and a protection cap which are cap units.

As shown in FIG. 1, in a liquid ejecting apparatus I of the present embodiment, a liquid ejecting head unit 1 is mounted on a carriage 2. The carriage 2 on which the liquid ejecting head unit 1 is mounted is provided so as to be movable in an axial direction with respect to a carriage shaft 2*a* which is attached to a housing 3.

In addition, the housing 3 is provided with a storage unit 4 in which a liquid is stored and the liquid from the storage unit 4 is supplied to the liquid ejecting head unit 1 which is mounted on the carriage 2 through a tube 4*a*. In addition, a blocking unit 5 which is a choke valve that blocks a flow path of each tube 4*a* is provided in the vicinity of the storage unit 4 of the tube 4*a*.

The carriage 2 on which the liquid ejecting head unit 1 is mounted is moved along the carriage shaft 2*a* through driving of the force of a driving motor 6 being transmitted to the carriage 2 through a plurality of pulleys 6*a* and a timing belt 6*b*. That is, in the present embodiment, the carriage 2, the driving motor 6, the plurality of pulleys 6*a*, the timing belt 6*b*, and the like constitute a movement mechanism. The housing 3 is provided with a transport roller 7 as a transport unit and a recording sheet S which is a recording medium such as paper is transported by the transport roller 7. The transport unit which transports the recording sheet S is not limited to the transport roller and may be a belt, a drum, or the like.

In such a liquid ejecting apparatus I, the carriage 2 moves along the carriage shaft 2*a* and a liquid lands on a recording sheet S by being discharged as liquid droplets by the liquid ejecting head unit 1.

In addition, a non-printing region on the side of the transport roller 7 which is an end portion of the carriage 2 in a movement direction is provided with a suction cap 8 and a protection cap 9 which are cap units, and a suction unit 8*a* is connected to the suction cap 8. The suction cap 8 may be used as a protection cap without providing the protection cap 9 separately from the suction cap 8.

In the example of above-described liquid ejecting apparatus I, the liquid ejecting head unit 1 moves in a main scanning direction by being mounted on the carriage 2, but the invention is not particularly limited thereto. For example, the invention can also be applied to a so-called line recording apparatus in which printing is performed only by moving a recording sheet S such as paper in a sub-scanning direction by fixing the liquid ejecting head unit 1 to the housing 3.

In addition, in the above-described example, the liquid ejecting apparatus I has a configuration in which the storage unit 4 is mounted in the housing 3, but the invention is not limited thereto. For example, a liquid may be supplied from outside of the liquid ejecting apparatus I without mounting the storage unit 4 in the housing 3.

Figure 3:
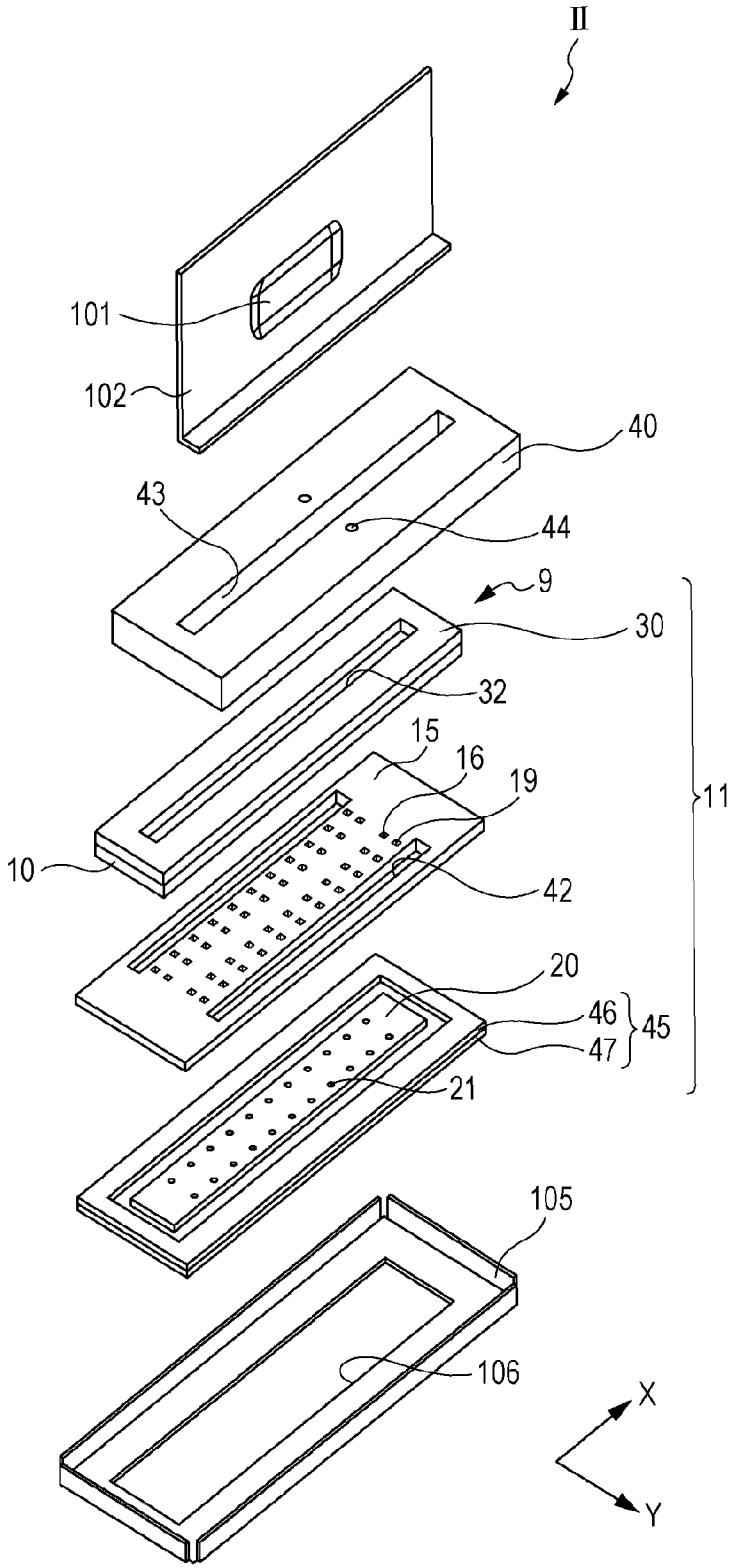
FIG. 3 is an exploded perspective view of a recording head according to Embodiment 1 of the invention.
Figure 4:
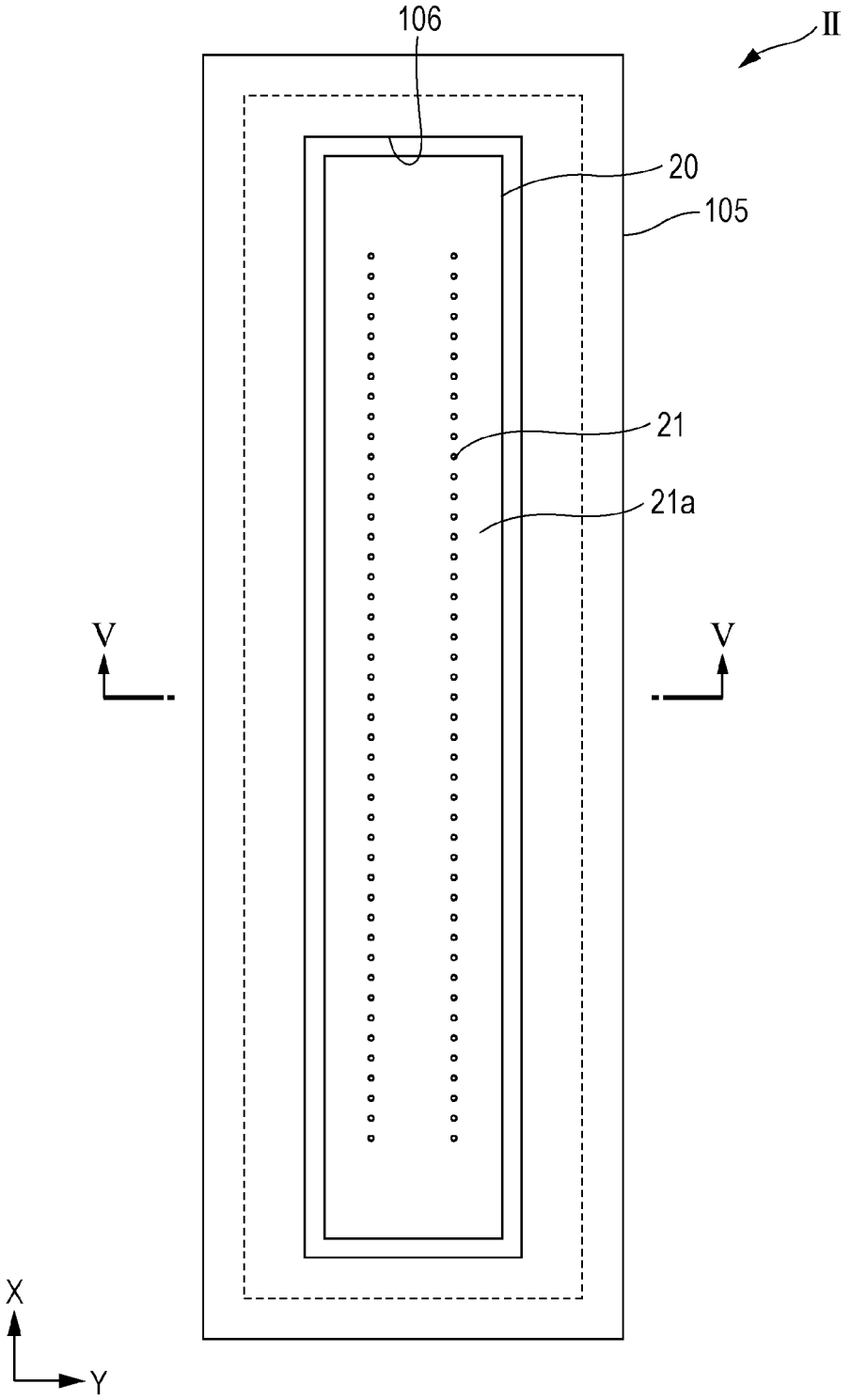
FIG. 4 is a plan view on a liquid ejecting surface side of the recording head according to Embodiment 1 of the invention.
Figure 5:
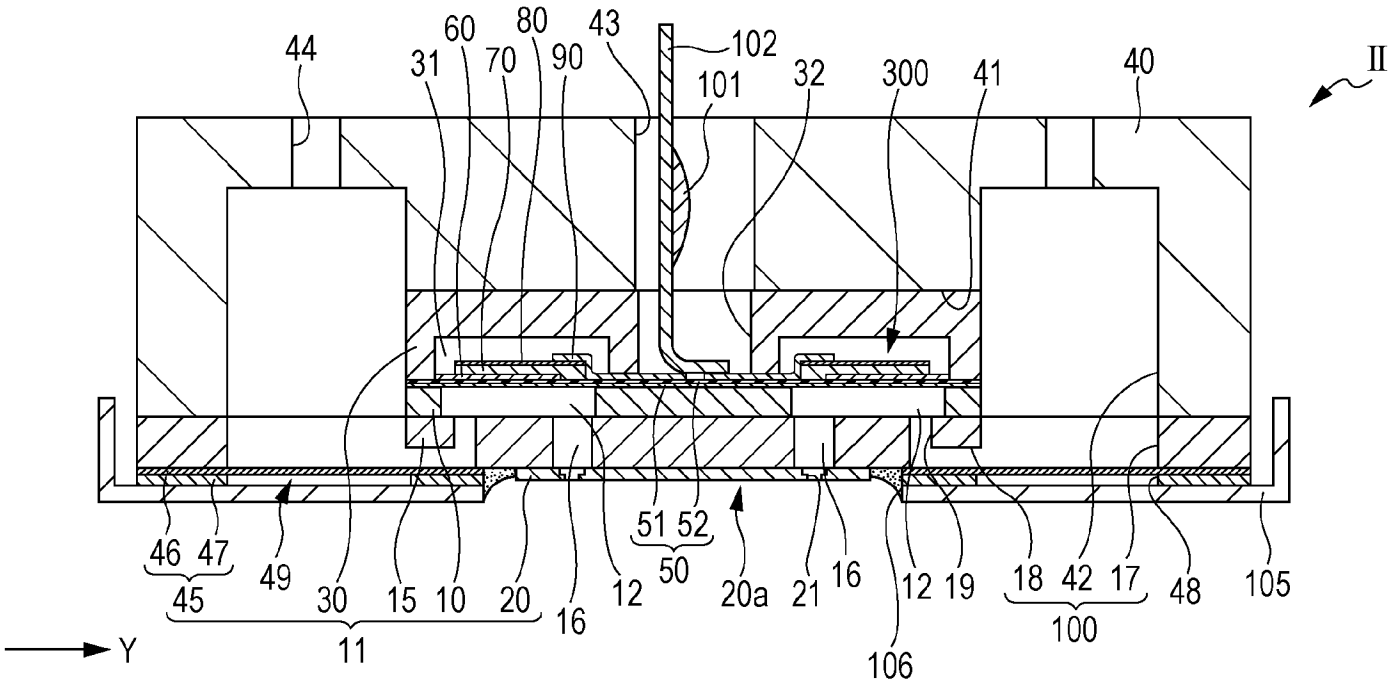
FIG. 5 is a cross-sectional view of the recording head according to Embodiment 1 of the invention.

Here, an example of an ink jet recording head constituting the head unit 1 mounted in such an ink jet recording apparatus will be described with reference to FIGS. 3 to 5. FIG. 3 is an exploded perspective view of an ink jet recording head, FIG. 4 is a plan view on a liquid ejecting surface side of the ink jet recording head, and FIG. 5 is a cross-sectional view taken along line IVA-IVA in FIG. 4.

As shown in the drawings, an ink jet recording head II of the present embodiment is provided with a plurality of members such as a head main body 11, a case member 40, and the like, and the plurality of members are bonded to each other using an adhesive. In the present embodiment, the ink jet recording head II is provided with the head main body 11, a flow path forming substrate 10, a communication plate 15, a nozzle plate 20, a protection substrate 30, and a compliance substrate 45.

In the flow path forming substrate 10 constituting the head main body 11, metal such as stainless steel or Ni; ceramic materials represented by $ZrO_2$ or $Al_2O_3$; glass ceramic materials; oxides such as MgO and $LaAlO_3$, and the like can be used. In the present embodiment, the flow path forming substrate 10 is constituted of a silicon single crystal substrate. Pressure generating chambers 12 which are partitioned by a plurality of partition walls by being subjected to anisotropic etching on one surface side are arranged in the flow path forming substrate 10 in parallel along a direction in which a plurality of nozzle openings 21 through which an ink is discharged are arranged in parallel. Hereinafter, this direction is referred to as a juxtaposition direction of a pressure generating chamber 12 or a first direction X. In addition, the flow path forming substrate 10 is provided with a plurality of rows of the pressure generating chambers 12 which are arranged in parallel in the first direction X, and in the present embodiment, two rows of the pressure generating chambers 12. Hereinafter, the row direction in which a plurality of rows of the pressure generating chambers 12 which are formed along the first direction X are arranged in rows is referred to as a second direction Y.

In addition, the flow path forming substrate 10 may be provided with a supply path or the like, of which the opening area is narrower than that of a pressure generating chamber 12 and which imparts flow path resistance to an ink flowing into the pressure generating chamber 12, on one end portion in the second direction Y of the pressure generating chamber 12.

In addition, the communication plate 15 is bonded to one surface side of the flow path forming substrate 10. In addition, the nozzle plate 20, in which a plurality of nozzle openings 21 that communicate with pressure generating chambers 12 are bored, is bonded to the communication plate 15.

The communication plate 15 is provided with a nozzle communication path 16 that communicates between the pressure generating chambers 12 and the nozzle openings 21. The communication plate 15 has an area which is larger than that of the flow path forming substrate 10 and the nozzle plate 20 has an area which is smaller than that of the flow path forming substrate 10. It is possible to achieve cost reduction by making the area of the nozzle plate 20 comparatively smaller in this manner. In the present embodiment, the surface on which the nozzle openings 21 of the nozzle plate 20 open and ink droplets are discharged is referred to as a liquid ejecting surface 20*a*.

In addition, the communication plate 15 is provided with a first manifold portion 17 and a second manifold portion 18 which constitute a part of a manifold 100.

The first manifold portion 17 is provided so as to penetrate the communication plate 15 in a thickness direction (stacking direction of the communication plate 15 and the flow path forming substrate 10).

In addition, the second manifold portion 18 is provided so as to open to the nozzle plate 20 of the communication plate 15 without penetrating the communication plate 15 in the thickness direction.

Furthermore, a supply communication path 19 which communicates with one end portion of the pressure generating chamber 12 in the second direction Y is independently provided on the communication plate 15 for each pressure generating chamber 12. The supply communication path 19 communicates between the second manifold portion 18 and the pressure generating chamber 12.

In such a communication plate 15, it is possible to use metal such as stainless steel or Ni, or ceramics such as zirconium. As the communication plate 15, a material which has a linear expansion coefficient the same as that of the flow path forming substrate 10 is preferable. That is, in a case where a material of which the linear expansion coefficient is greatly different from that of the flow path forming substrate 10 is used as the communication plate 15, warpage occurs due to the difference in the linear expansion coefficient between the flow path forming substrate 10 and the communication plate 15 due to heating or cooling. In the present embodiment, it is possible to suppress generation of warpage due to heat, cracks or peeling due to heat, or the like using the material of which the linear expansion coefficient is the same as that of the flow path forming substrate 10 as the communication plate 15, that is, the silicon single crystal substrate.

In addition, the nozzle openings 21 which communicate with the pressure generating chambers 12 through the nozzle communication path 16 are formed on the nozzle plate 20. That is, the nozzle openings 21 which eject the same kind of liquid (ink) are arranged in parallel in the first direction X, and the rows of the nozzle openings 21 which are arranged in parallel in the first direction X are formed in two rows in the second direction Y.

In such a nozzle plate 20, for example, it is possible to use metal such as stainless steel (SUS), organic substances such as polyimide resin, silicon single crystal substrates, or the like. It is possible to suppress generation of warpage due to heating or cooling, cracks or peeling due to heat, or the like using the silicon single crystal substrate as the nozzle plate 20, thereby making the linear expansion coefficients between the nozzle plate 20 and the communication plate 15 the same as each other.

In contrast, a vibrating plate 50 is formed on a surface side which is opposite to the communication plate 15 of the flow path forming substrate 10. In the present embodiment, an elastic film 51 which is formed of silicon oxide and is provided on the flow path forming substrate 10 and an insulator film 52 which is formed of zirconium oxide and is provided on the elastic film 51 are provided as the vibrating plate 50. The liquid flow path such as the pressure generating chamber 12 is formed by being subjected to anisotropic etching of the flow path forming substrate 10 from one surface side, that is, the surface side to which the nozzle plate 20 is bonded. The other surface of the liquid flow path such as the pressure generating chamber 12 is demarcated by the elastic film 51.

In addition, in the present embodiment, a first electrode 60, a piezoelectric layer 70, and a second electrode 80 are stacked and formed on the insulator film 52 of the vibrating plate 50 through a film forming method and a lithography method to constitute a piezoelectric actuator 300. Here, the piezoelectric actuator 300 is also called piezoelectric element 300 and indicates a portion which includes the first electrode 60, the piezoelectric layer 70, and the second electrode 80. In general, any one electrode of the piezoelectric actuator 300 is set to a common electrode, and the other electrode and the piezoelectric layer 70 are formed by being patterned for each pressure generating chamber 12. Here, the portion, which is formed of any one electrode and the piezoelectric layer 70 that are patterned and in which a piezoelectric strain is caused through application of a voltage to both the electrodes, is called a piezoelectric body active portion. In the present embodiment, the first electrode 60 is set to the common electrode of the piezoelectric actuator 300 and the second electrode 80 is set to a separate electrode of the piezoelectric actuator 300. However, there is no problem even if this setting is reversed due to circumstances related to driving circuits or wirings. In the above-described example, the first electrode 60 is continuously provided over a plurality of pressure generating chamber 12, and therefore, the first electrode 60 functions as a part of the vibrating plate. However, as a matter of course, the invention is not limited thereto, and for example, the first electrode 60 may act alone as the vibrating plate without providing either or both of the above-described elastic film 51 and insulator film 52.

In addition, the protection substrate 30 which has a size substantially the same as that of the flow path forming substrate 10 is bonded to the surface on the piezoelectric actuator 300 of the flow path forming substrate 10. The protection substrate 30 has a holding portion 31 which is a space for protecting the piezoelectric actuator 300. In addition, a through hole 32 penetrating in the thickness direction (stacking direction between the flow path forming substrate 10 and the protection substrate 30) is formed in the protection substrate 30. One end portion on a side opposite to the other end portion of the second electrode 80 of a lead electrode 90 is extended so as to be exposed in the through hole 32. The lead electrode 90 and a wiring substrate 102, on which a driving circuit 101 such as a driving IC is mounted, are electrically connected to each other in the through hole 32.

In addition, a case member 40 in which the manifold 100 that communicates with a plurality of pressure generating chambers 12 is demarcated together with the head main body 11 is fixed to the head main body 11 having the above-described configuration. The case member 40 has a shape substantially the same as that of the above-described communication plate 15 in plan view. Moreover, the case member is bonded to the protection substrate 30 and also to the above-described communication plate 15. Specifically, the case member 40 has a recess 41 with a depth for accommodating the flow path forming substrate 10 and the protection substrate 30 on the protection substrate 30 side. The recess 41 has an opening area which is wider than the surface of the protection substrate 30 which is bonded to the flow path forming substrate 10. The surface of the opening on the nozzle plate 20 side of the recess 41 is sealed by the communication plate 15 in a state where the flow path forming substrate 10 or the like is accommodated in the recess 41. Accordingly, a third manifold portion 42 is demarcated on the outer circumferential portion of the flow path forming substrate 10 by the case member 40 and the head main body 11. The manifold 100 of the present embodiment is formed by the first manifold portion 17 and the second manifold portion 18, which are provided on the communication plate 15, and the third manifold portion 42 which is demarcated by the case member 40 and the head main body 11.

As the material of the case member 40, for example, resin, metal, or the like can be used. Incidentally, it is possible to mass-produce the case member 40 at low cost by molding a resin material as the case member.

In addition, the compliance substrate 45 is provided on the surface to which the first manifold portion 17 and the second manifold portion 18 of the communication plate 15 open. The compliance substrate 45 seals the opening of the first manifold portion 17 and the second manifold portion 18 on the liquid ejecting surface 20*a* side.

Such a compliance substrate 45 is provided with a sealing film 46 and a fixing substrate 47 in the present embodiment. The sealing film 46 is constituted of a flexible thin film (for example, a thin film which has a thickness of less than or equal to 20 μm and is formed of polyphenylene sulfide (PPS), stainless steel (SUS), or the like), and the fixing substrate 47 is formed of a hard material, for example metal such as stainless steel (SUS). A region of the fixing substrate 47 facing the manifold 100 is set to an opening 48 which is completely removed in the thickness direction, and therefore, one surface of the manifold 100 is set to a compliance portion as a flexible portion which is sealed only by the flexible sealing film 46.

An introduction path 44 which communicates with the manifold 100 and is used for supplying an ink to each manifold 100 is provided in the case member 40. In addition, a connection port 43 which communicates with the through hole 32 of the protection substrate 30 and into which the wiring substrate 102 is inserted is provided in the case member 40.

In the ink jet recording head II with such a configuration, when ejecting an ink, the ink is taken in from an ink cartridge through the introduction path 44 and the inside of the flow path is filled with the ink until the ink reaches the nozzle opening 21 from the manifold 100. Then, the vibrating plate 50 is warped and deformed together with the piezoelectric actuator 300 by applying a voltage to each piezoelectric actuator 300 corresponding to the pressure generating chamber 12 in accordance with a signal from the driving circuit 101. Accordingly, the pressure in the pressure generating chamber 12 increases and ink droplets are ejected from the nozzle opening 21. In the ink jet recording head II of the present embodiment, the path from the introduction path 44 to the nozzle opening 21 is referred to as a liquid flow path. That is, the liquid flow path is formed by the introduction path 44, the manifold 100, the supply communication path 19, the pressure generating chamber 12, the nozzle communication path 16, and the nozzle opening 21.

In addition, a cover head 105 which is a protection member of the present embodiment is provided on the liquid ejecting surface 20*a* side of the head main body 11. The cover head 105 is bonded to the compliance substrate 45 on a surface side opposite to the communication plate 15, and seals a space on a side opposite to the flow path (manifold 100) of a compliance portion 49. An exposure opening 106 in which the nozzle opening 21 is exposed is provided in the cover head 105. In the present embodiment, the exposure opening 106 has an opening with a size sufficient for exposing the nozzle plate 20, that is, an opening which is the same size as that of the compliance substrate 45.

In addition, in the present embodiment, the cover head 105 is provided such that the end portion of the cover head is curved from the liquid ejecting surface 20*a* side so as to cover the side surface (surface intersecting with the liquid ejecting surface 20*a*) of the head main body 11.

In the present embodiment, such a cover head 105 is provided protrusively further on the recording sheet S than the liquid ejecting surface 20*a* of the nozzle plate 20 in a discharging direction of an ink (liquid). It is difficult for the recording sheet S to come into contact with the nozzle plate 20 by making the cover head 105 protrude further on the recording sheet S side than the liquid ejecting surface 20*a*. Therefore, it is possible to suppress deformation of the nozzle plate 20 and generation of peeling or the like due to contact between the recording sheet S and the nozzle plate 20.

In addition, a liquid repellent film which has a liquid repellent property may be provided on a surface on a side the same as the liquid ejecting surface 20*a* of such a cover head 105, that is, a surface on a side opposite to the compliance substrate 45, similarly to the nozzle plate 20.

The region which is capped by the suction cap 8 or the protection cap 9 is a portion that includes the entire nozzle plate 20 and a region, which corresponds to at least a part of the manifold 100 on a plane along the liquid ejecting surface 20*a*, that is, a portion that includes a region in which the end portion of the suction cap 8 or the protection cap 9 corresponds to a certain compliance portion as a flexible portion which is sealed only by the flexible sealing film 46 of the compliance substrate 45 that defines the manifold 100.

Such an ink jet recording head II is mounted in the ink jet recording apparatus I such that the second direction Y becomes a main scanning direction which is a movement direction of the carriage 2.

Figure 6:
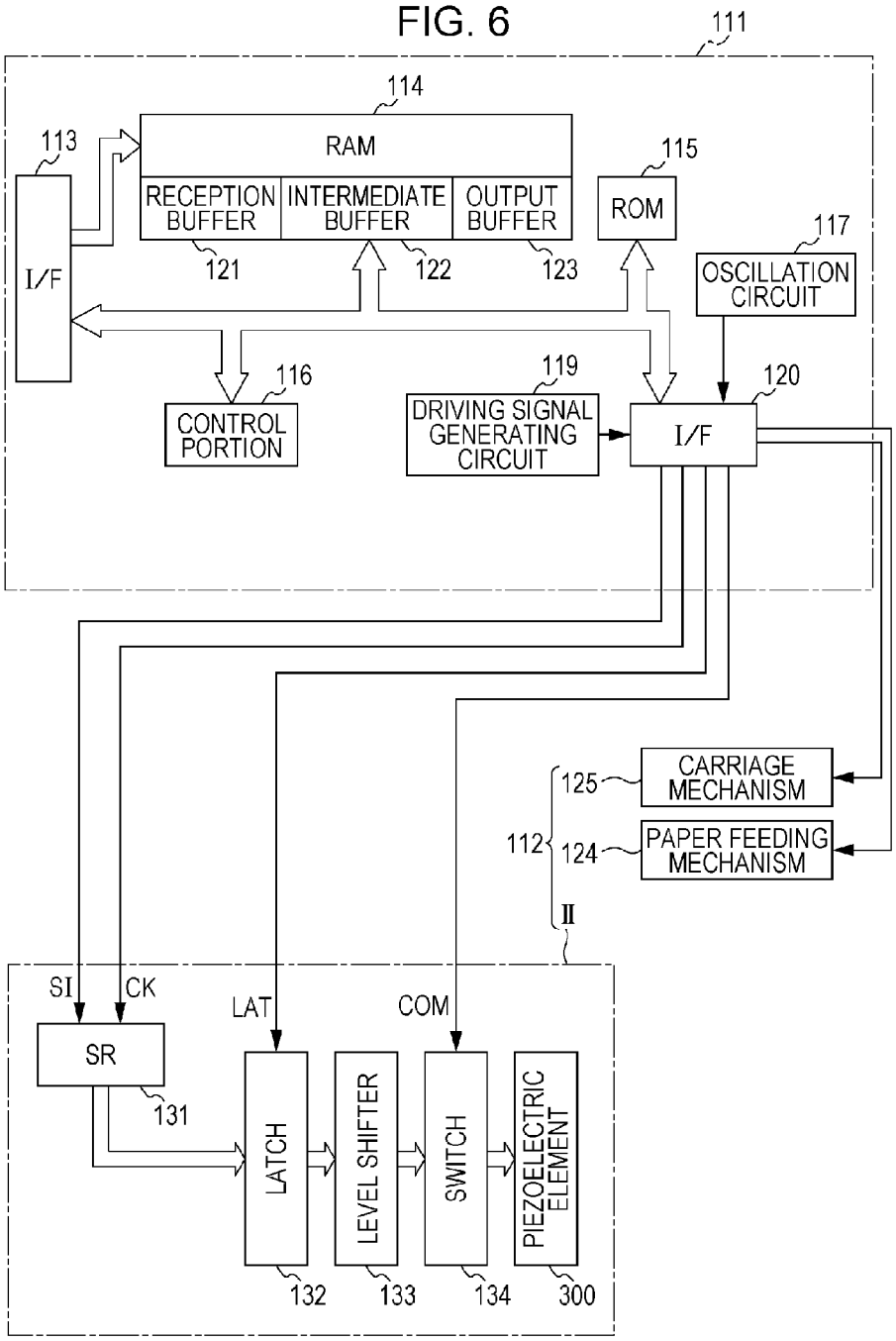
FIG. 6 is a view showing a control configuration of the recording apparatus according to Embodiment 1 of the invention.

Here, a control configuration of the ink jet recording apparatus I of the present embodiment will be described. FIG. 6 is a block diagram showing a control configuration of the ink jet recording apparatus and a liquid ejecting head inspecting device.

The control configuration of the ink jet recording apparatus I of the present embodiment is schematically constituted of a printer controller 111 and a print engine 112 as shown in FIG. 6. The printer controller 111 includes an outer interface 113 (hereinafter, referred to as an outer I/F 113); a RAM 114 which temporarily stores various data; a ROM 115 which stores a control program or the like; a control portion 116 which is configured to have a CPU or the like; an oscillation circuit 117 which generates a block signal; a driving signal generating circuit 119 which generates a driving signal for supplying the driving signal to the ink jet recording head II; and an internal interface 120 (hereinafter, referred to as an internal I/F 120) which transmits dot pattern data (bit map data) or the like, which are developed based on the driving signal or print data, to the print engine 112.

The outer I/F 113 receives print data, constituted of, for example, a character code, a graphic function, image data, or the like, from a host computer or the like which is not shown in the drawing. In addition, a busy signal (BUSY) or an acknowledge signal (ACK) is output to the host computer or the like through this outer I/F 113. The RAM 114 functions as a reception buffer 121, an intermediate buffer 122, an output buffer 123, and a work memory which is not shown in the drawing. Moreover, the reception buffer 121 temporarily stores print data which is received by the outer I/F 113; the intermediate buffer 122 stores intermediate code data which is converted by the control portion 116; and the output buffer 123 stores dot pattern data. The dot pattern data is constituted of the print data which is obtained by decoding (translating) gradation data.

The ROM 115 stores font data, a graphic function, or the like in addition to the control program (control routine) for performing various kinds of data processing. The control portion 116 reads print data in the reception buffer 121 and stores the intermediate code data, which is obtained by converting the print data, in the intermediate buffer 122. In addition, the intermediate code data which is read from the intermediate buffer 122 is analyzed and is developed into dot pattern data by referring to the font data, the graphic function, and the like which are stored in ROM 115. The control portion 116 performs required decoration processing, and then, stores the developed dot pattern data in the output buffer 123.

When dot pattern data corresponding to one line of the ink jet recording head II can be obtained, the dot pattern data of the one line is output to the ink jet recording head II through the internal I/F 120. In addition, when the dot pattern data of the one line is output from the output buffer 123, the developed intermediate code data is removed from the intermediate buffer 122, and development processing is performed on the next intermediate code data.

The print engine 112 is configured to include the ink jet recording head II, a paper feeding mechanism 124, and a carriage mechanism 125. The paper feeding mechanism 124 is constituted of a paper feeding roller and a paper feeding motor which rotates the paper feeding roller, a transport roller 7 or the like. The paper feeding mechanism sequentially sends a print storage medium such as recording paper in conjunction with a recording operation of the ink jet recording head II. That is, the paper feeding mechanism 124 moves the print storage medium relatively to the sub-scanning direction.

The carriage mechanism 125 is constituted of the carriage 2 on which the ink jet recording head II can be mounted; and a carriage driving portion in which the carriage 2 travels along the carriage shaft 2*a* in the main scanning direction. The carriage mechanism moves the ink jet recording head II in the main scanning direction by making the carriage 2 travel. The carriage driving portion is constituted of the driving motor 6, the timing belt 6*b*, and the like as described above.

The ink jet recording head II has many nozzle openings 21 along the sub-scanning direction and discharges ink droplets through each of the nozzle openings 21 at a timing which is determined using dot pattern data or the like. An electrical signal, for example, a driving signal for discharge (COM), print data (SI), or the like, to be described later, is supplied to the piezoelectric element 300 of such an ink jet recording head II through an external wiring which is not shown in the drawings. In the printer controller 111 and the print engine 112 which are constituted in this manner, the printer controller 111 and a driving circuit (not shown in the drawings) which has: a latch 132 which selectively inputs a driving signal having a predetermined driving waveform that is output from the driving signal generating circuit 119, into the piezoelectric element 300; a level shifter 133; a switch 134; and the like become a driving unit that applies a driving signal to the piezoelectric element 300.

A shift register (SR) 131, the latch 132, the level shifter 133, the switch 134, and the piezoelectric element 300 are provided in each of the nozzle openings 21 of the ink jet recording head II, and the shift resister 131, the latch 132, the level shifter 133, and the switch 134 create a driving pulse from the driving signal for discharging or a driving signal for destroying which are generated by the driving signal generating circuit 119. Here, the driving pulse actually refers to an application pulse which is applied to the piezoelectric element 300.

In such an ink jet recording head II, first, print data (SI) constituting the dot pattern data are sequentially set by being serially transmitted to the shift resister 131 from the output buffer 123 in synchronization with clock signals (CK) from the oscillation circuit 117. In this case, first, data of the most significant bit in the print data of all of the nozzle openings 21 is serially transmitted to the shift resister. If the serial transmission of the data of the most significant bit is completed, data of a second bit from the highest-order is serially transmitted. Similarly, data of a lower-order bit is serially transmitted hereinafter.

If print data of the bits for all of nozzles are set to each shift resister 131, the control portion 116 outputs a latch signal (LAT) to the latch 132 at a predetermined timing. The latch 132 latches the print data which have been set to the shift resister 131 due to the latch signal. The print data (LATout) which have been latched by this latch 132 are applied to the level shifter 133 which is a voltage amplifier. In a case where print data is, for example, "1", this level shifter 133 boosts the print data to a voltage value at which the switch 134 can be driven, for example, to several tens of volts. This boosted print data is applied to each switch 134 which enters a connection state due to the print data.

The driving signal (CMO) which has been generated by the driving signal generating circuit 119 is also applied to each switch 134. When each switch 134 selectively enters a connection state, the driving signal is selectively applied to the piezoelectric element 300 which is connected to the switch 134. In this manner, in the exemplified ink jet recording head II, it is possible to control whether a driving signal for discharging is applied to the piezoelectric element 300 through the print data. For example, in a period of "1" in the print data, the switch 134 enters a connection state due to the latch signal (LAT). Therefore, the driving signal (COMout) can be supplied to the piezoelectric element 300 which is displaced (deformed) by the supplied driving signal (COMout). In addition, in a period of "0" in the print data, the switch 134 enters a non-connection state, and therefore, the supply of the driving signal to the piezoelectric element 300 is blocked. In the period of "0" in the print data, each piezoelectric element 300 holds a potential immediately before the period, and therefore, maintains a displacement state immediately before the period.

In such an ink jet recording head II, the volume of the pressure generating chamber 12 corresponding to charging/discharging with respect to the piezoelectric element 300 changes, and therefore, it is possible to discharge ink droplets through the nozzle opening 21 using the change in the pressure of the pressure generating chamber 12.

In addition, such a control portion 116 controls the driving signal generating circuit 119 so as to supply a driving signal for discharging, with which ink droplets can be discharged from the nozzle openings 21, and a driving signal for destroying, with which a meniscus of a liquid (ink) of a nozzle opening 21 is destroyed so as not to discharge the liquid.

The driving signal for discharging is a signal that has a discharge pulse, which drives (discharge-drives) the piezoelectric element 300 as a driving element so as to discharge ink droplets, within one recording period T, and is generated repeatedly for each recording period T.

In contrast, The driving signal for destroying drives the piezoelectric element 300 which is a driving element, destroys a meniscus of an ink (liquid) which has been formed in a nozzle opening 21, and draws air from the nozzle opening 21 due to the discharge-driving. Such a driving signal for destroying is formed as a signal which is obtained by, for example, appropriately changing the voltage, the application time, and the period of the driving signal for discharging. In general, the driving signal for destroying preferably has a period shorter than that of the driving signal for discharging, and the application voltage, that is, the amplitude of the driving signal for destroying is preferably made large. Accordingly, a large amount of an ink can be efficiently discharged once, and as a result, a state where the supply of an ink is insufficient is created, and therefore, it is possible to draw air from the nozzle openings 21 using a negative pressure. The mode using such a driving signal for destroying will be described later.

The printer controller 111 which is a control unit of the present embodiment carries out an operation of a discharge unit, that is, Mode 1 in the present embodiment in which the piezoelectric element 300 that is a driving element is operated and an ink is discharged such that air is drawn into the pressure generating chamber 12 from the nozzle opening 21, in addition to Mode 2 in which the piezoelectric element 300 that is the driving element is driven such that air is not drawn into the pressure generating chamber 12 from the nozzle opening 21 as described above.

Figure 7:
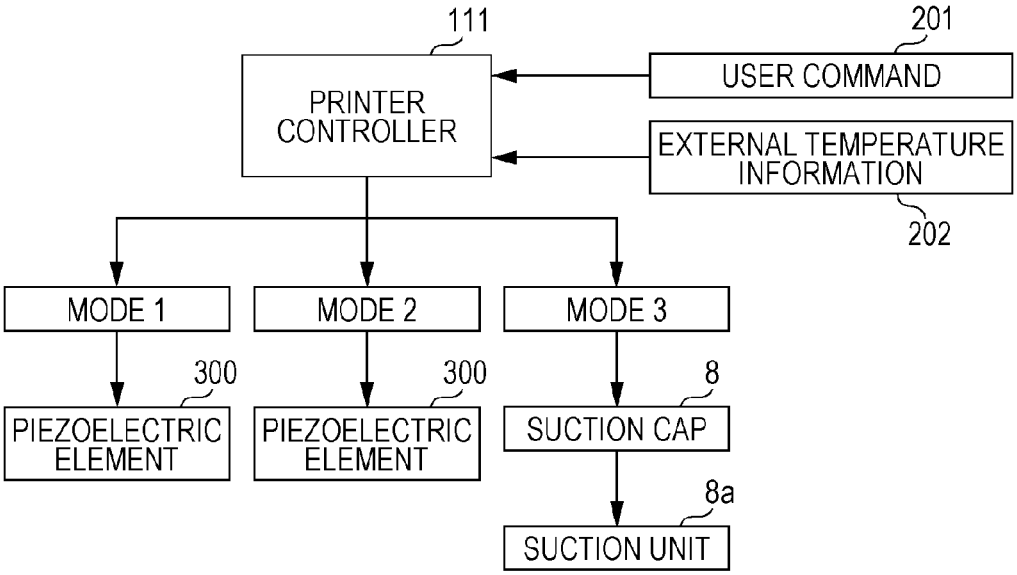
FIG. 7 is a view for illustrating each mode of the recording apparatus according to Embodiment 1 of the invention.

FIG. 7 is a view illustrating states where modes 1 to 3 of the printer controller 111 are carried out.

Mode 1 is executed to prevent a vibrating plate or the like from being destroyed by an increase in the pressure in the pressure generating chamber 12 due to freezing of a liquid in the pressure generating chamber 12 or the manifold 100, and is carried out when the apparatus has not been used for a long period of time, when moving and transporting the product, when the environmental temperature in use is lower than the temperature at which a liquid freezes, and the like. Mode 1 is performed based on a user command 201, for example, when a user turns on a switch for selecting Mode 1. The printer controller 111 acquires external temperature information 202 from a detection unit such as a temperature sensor that measures the environmental temperature, in addition to the user command 201. Mode 1 may be carried out based on a determination of whether Mode 1 is carried out based on the acquired external temperature information and the user command. In either case where the execution of Mode 1 depends on the selection by a user or where the execution of Mode 1 depends on the detection result of the detection unit, it is possible to prevent the vibrating plate or the like from being destroyed, and Mode 1 is executed with high operability.

Mode 1 is carried out to drive the piezoelectric element 300 using the above-described driving signal for destroying, in the present embodiment, and accordingly, air is drawn from the nozzle opening 21.

The driving signal for destroying may be sent to all of the piezoelectric elements 300, but may be supplied only to piezoelectric elements 300 corresponding to some nozzle openings 21 in which a meniscus is to be destroyed.

When a piezoelectric element 300 is driven by the driving signal for destroying, a meniscus moves in the direction of a pressure generating chamber 12 from the vicinity of a nozzle opening 21 due to discharge of a liquid from the nozzle opening 21, and the area of the meniscus increases, and therefore, it is possible to draw air due to the negative pressure. In addition, supply of a liquid is insufficient due to the discharge of the liquid from the nozzle opening 21, the negative pressure in the pressure generating chamber 12 communicating with the nozzle opening increases, and air is drawn into the pressure generating chamber 12 from the nozzle opening 21. Even if the temperature is at a temperature at which the liquid freezes after the pressure generating chamber 12 is filled with air in this manner, the destruction of the vibrating plate or the like due to the freezing of the pressure generating chamber 12 is prevented.

In addition, when air is sufficiently drawn using a plurality of places at which the air is drawn into pressure generating chambers 12 from the above-described nozzle openings 21, the air accumulates in the manifold 100 and also in a flow path between the manifold 100 and pressure generating chambers 12 into which air has not been drawn from the nozzle openings 21, and a meniscus is formed in the flow path. By doing this, even if a liquid in the manifold 100 freezes, air exists in a part of the flow path which communicates between the pressure generating chambers 12 and the manifold 100, and therefore, the escape route is not blocked even if the pressure in the pressure generating chambers 12 increases. As a result, the destruction of the vibrating plate or the like is prevented.

As described above, supply of the driving signal for destroying may be performed on all of the piezoelectric elements 300 or on some piezoelectric elements 300. However, in both cases, air is drawn into the manifold 100 from at least some nozzle openings 21, and a meniscus is formed in a flow path, between the manifold 100 and pressure generating chamber 12, which communicates with nozzle openings 21 into which air has not been drawn. As a result, destruction of the vibrating plate or the like due to freezing in all of the pressure generating chambers 12 is prevented. In this manner, Mode 1 may be completed at a point in time at which a meniscus is formed in a flow path, between the manifold 100 and the pressure generating chambers 12, which communicates with nozzle openings 21 into which air has not been drawn, by air being drawn into the manifold 100 due to air being drawn into some pressure generating chambers 12 without being drawn into all of the pressure generating chambers 12. Accordingly, control of the apparatus becomes easier than in a case where air is drawn into all of the pressure generating chambers 12.

The drawing of air through Mode 1 is performed by the driving signal for destroying in the present embodiment. However, the drawing of air may be performed using a general driving signal for evacuation without preparing such a particular driving signal.

In addition, when carrying out Mode 1, an ink is discharged through nozzle openings 21. However, the discharge region for carrying out Mode 1 may be particularly provided, or Mode 1 may be performed in a region opposite to the suction cap 8.

Figure 8A:
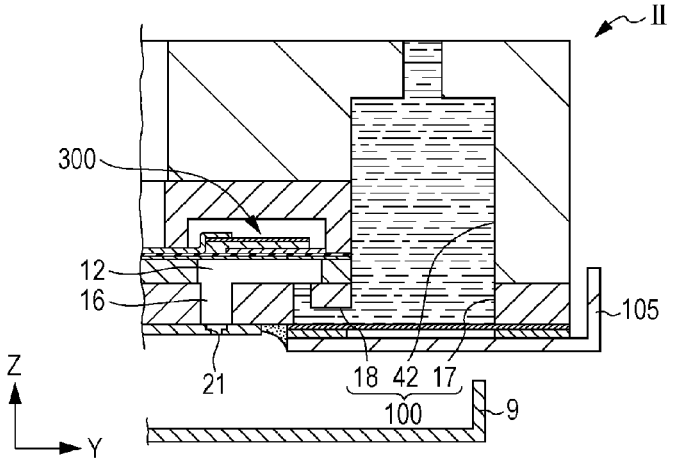
FIGS. 8A to 8C are schematic views for illustrating states after performing Mode 1.
Figure 8B:
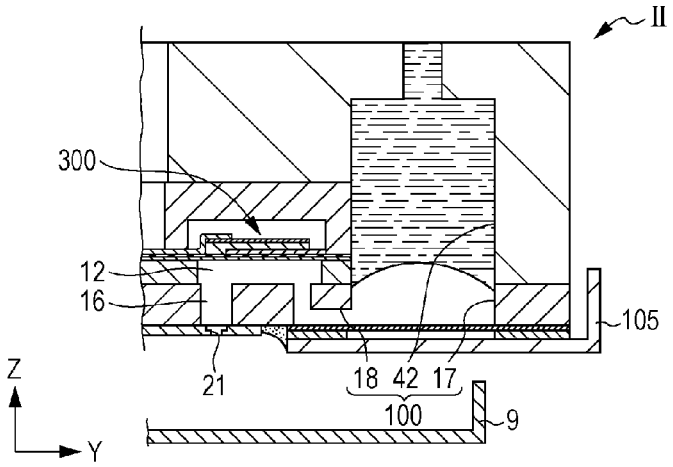
Figure 8C:
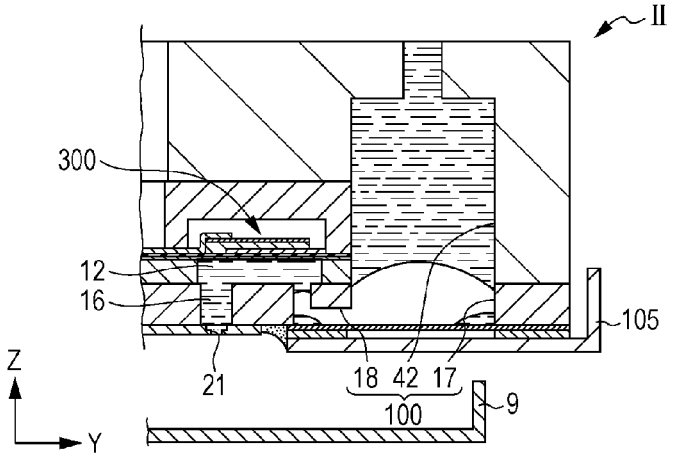

FIGS. 8A to 8C schematically show such states of drawing air. In FIGS. 8A to 8C, the liquid is represented by a dot pattern and the air is represented by a white background.

FIG. 8A shows a state in which air is drawn into a pressure generating chamber 12 from a nozzle opening 21, FIG. 8B shows a state in which air is further drawn into and accumulates in the manifold 100, and FIG. 8C shows a state in which the air accumulating in the manifold 100 forms a meniscus in a flow path between a manifold 100 and a pressure generating chamber 12 which communicates with a nozzle opening 21 into which air has not been drawn.

That is, in either case where the driving signal for destroying is supplied to all of piezoelectric elements 300 or where the driving signal for destroying is supplied to some piezoelectric elements 300, nozzle openings 21 in three states of FIGS. 8A to 8C coexist.

Figure 9A:
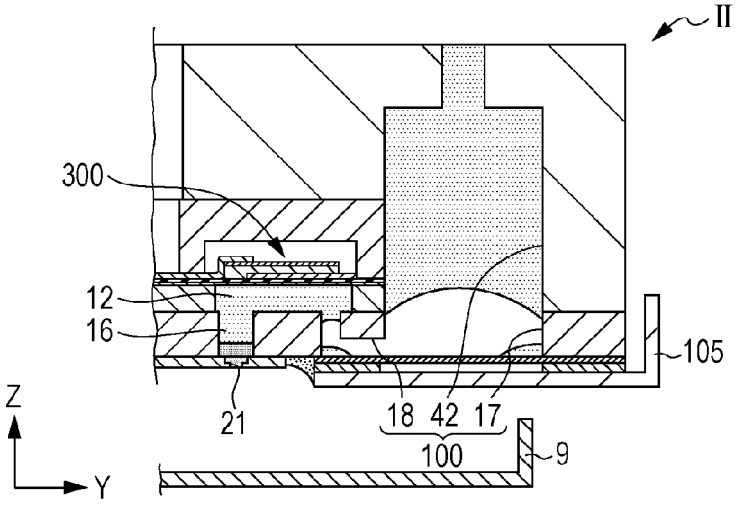
FIGS. 9A and 9B are schematic views for illustrating frozen states after performing Mode 1.
Figure 9B:
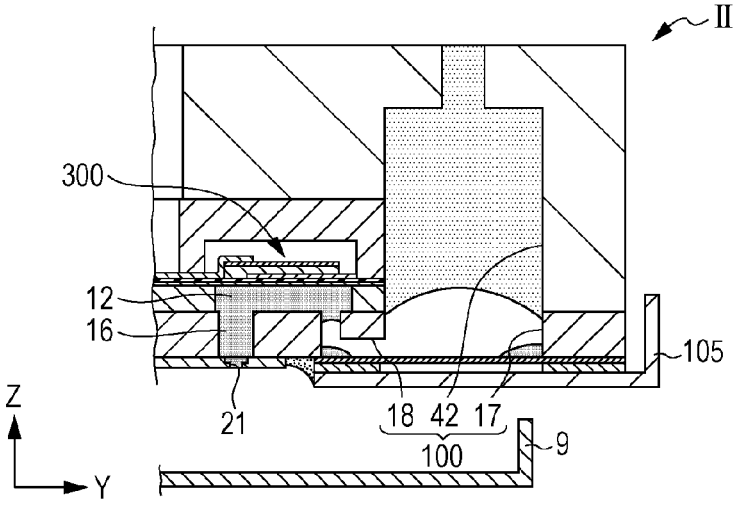

FIGS. 9A and 9B schematically show states when a liquid freezes in such states. In FIGS. 9A and 9B, the liquid is represented by a dot pattern, the frozen portion is represented by gray, and the air is represented by a white background.

FIGS. 9A and 9B show states where the pressure generating chamber 12 in the state in FIG. 8C freeze. In the beginning of the freezing, only a liquid in the nozzle opening 21 freezes. However, when the freezing progresses, a liquid in the pressure generating chamber 12 or a liquid in the manifold 100 also freezes as shown in FIG. 9B. Since air exists in the manifold 100 and also in the flow path which communicates with the pressure generating chamber 12, the pressure from the pressure generating chamber 12 side can escape into the inside of the manifold 100 without blocking the flow path, and therefore, destruction of a vibrating plate or the like in the pressure generating chamber 12 is prevented.

Figure 10A:
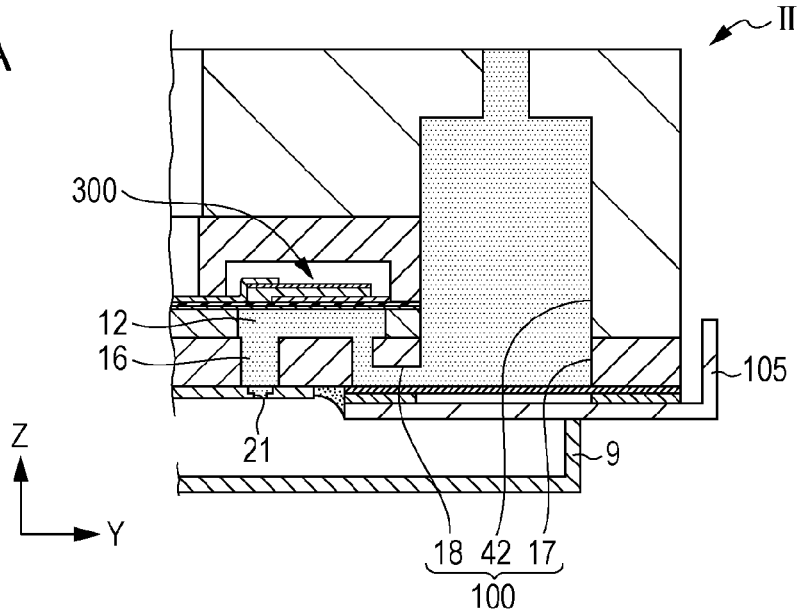
FIGS. 10A and 10B are schematic views for illustrating frozen states in cases where Mode 1 is not performed.
Figure 10B:
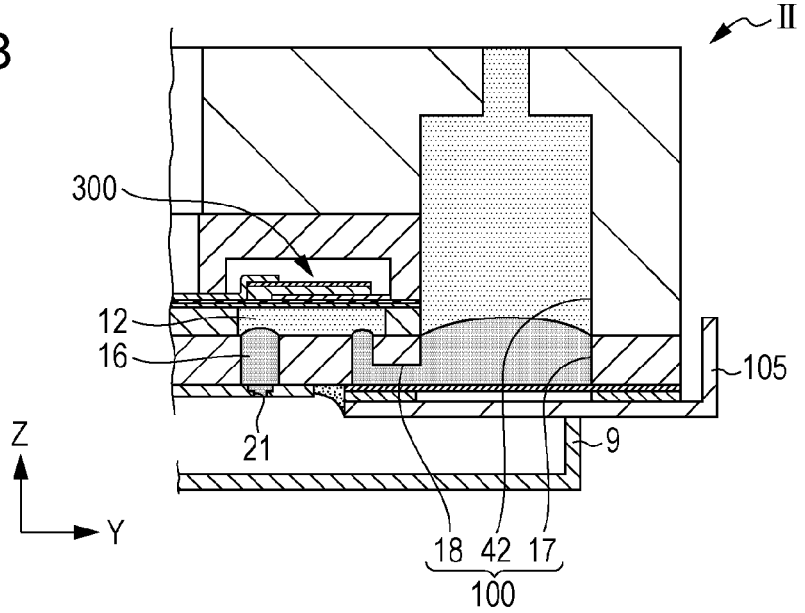

FIGS. 10A and 10B show states in cases where Mode 1 is not performed. In FIGS. 10A and 10B, the liquid is represented by a dot pattern, the frozen portion is represented by gray, and the air is represented by a white background.

When freezing is caused in a state where the portion from the nozzle opening 21 to the manifold 100 is filled with a liquid as shown in FIG. 10A, freezing starts from the nozzle opening 21 side and the manifold 100 as shown in FIG. 10B. If the flow path which communicates between the pressure generating chamber 12 and the manifold 100 freezes, there is no space for the pressure to escape into the pressure generating chamber 12 even if a liquid in the pressure generating chamber 12 does not freeze, and therefore, destruction of a vibrating plate or the like is caused.

Hereinabove, an example of carrying out Mode 1 of the embodiment has been described. In a case where Mode 1 is carried out by driving the piezoelectric element 300 using the driving signal for destroying, Mode 1 may be performed by stopping supply of a liquid using the blocking unit 5 which is a choke valve that stops the supply of a liquid from the storage unit 4. Accordingly, the amount of a liquid unnecessarily discharged until air is drawn from the nozzle opening 21 decreases and Mode 1 can be carried out in a short period of time, which is preferable.

In addition, Mode 1 is carried out by driving the piezoelectric element 300, and therefore, it is possible to simplify control of the liquid ejecting apparatus.

Mode 2 shown in FIG. 7 is a general mode for printing and Mode 3 is a mode for recovery. After air is drawn into the flow path by executing Mode 1, Mode 3 is carried out before carrying out printing through Mode 2. That is, after Mode 1 is carried out, Mode 3 is always carried out before Mode 2. Accordingly, it is possible to prevent the result of discharging of a liquid to a medium to be discharged from being defective due to Mode 2 being carried out without performing Mode 3.

Mode 3 is carried out to discharge air in the pressure generating chamber 12 or the manifold 100 through the nozzle opening 21 and is performed using the suction cap 8 and the suction unit 8*a* in the present embodiment as maintenance units. This is the same as general suction recovery. Units for pressurizing a liquid from an upstream side may be mounted as the maintenance units after Mode 1 is performed.

In Mode 3 according to the suction recovery, the manifold 100, the pressure generating chamber 12, and the nozzle opening 21 are filled with a liquid through drawing air and the liquid, by moving the carriage 2 to a place facing the suction cap 8 using the carriage mechanism as shown in FIG. 2, making the suction cap 8 abut onto the nozzle plate 20, and sucking the air and the liquid from the nozzle opening 21 using the suction unit 8*a*.

After carrying out Mode 1, in a case where the apparatus is being left as it is or transported, the power is turned off and the nozzle plate 20 is usually protected by the protection cap 9. However, the protection of the nozzle plate using the protection cap 9 may not be performed. In the present embodiment, the protection of the nozzle plate using the protection cap 9 is not performed after Mode 1 is performed.

Figure 11A:
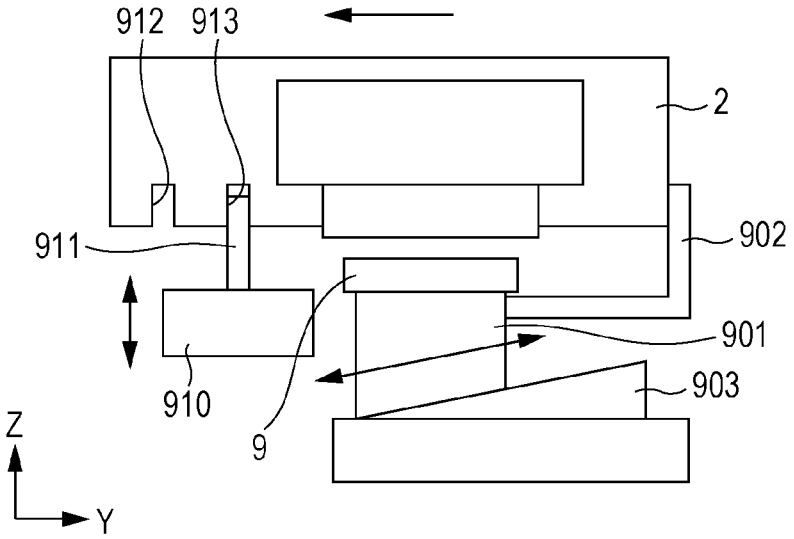
FIGS. 11A and 11B are schematic views for illustrating caps of Embodiments 1 and 2.
Figure 11B:
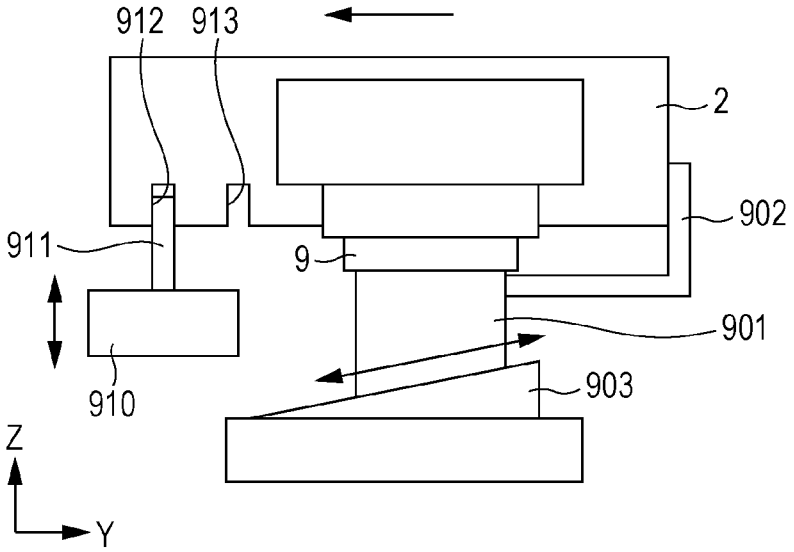

This state is shown in FIGS. 11A and 11B. FIG. 11A illustrates a state where although the carriage 2 moves to a region facing the protection cap 9 due to the power being turned off, the protection cap 9 is stopped in a state of not being closely adhered to the nozzle plate 20. This state is set to a stopped state after Mode 1.

When the carriage 2 moves to a region facing the protection cap 9 in a non-printing region, a locking member 902 which is provided on a support member 901 that supports the protection cap 9 is locked to the carriage 2, and the protection cap 9 and the support member 901 move obliquely upward along a tilting table 903. The FIG. 11A is in a state where the protection cap 9 and the support member 901 do not move along the tilting table 903 and FIG. 11B is in a state where the protection cap 9 and the support member 901 move obliquely upward along the tilting table 903 and the protection cap 9 is closely adhered to the nozzle plate 20.

In the state shown in FIG. 11B, a locking rod 911 of a carriage lock mechanism 910, which is a regulating unit that regulates the movement of the carriage 2, is inserted into a rocking hole 912 of the carriage 2 so as to be fixed thereto. This carriage lock mechanism 910 is usually used during transportation. In the present embodiment, a second locking hole 913 is provided in the carriage 2 in order to fix the carriage 2 thereto in the state shown in FIG. 11A, that is, in a state where the protection cap 9 is not closely adhered to the nozzle plate 20, in consideration of transportation after carrying out Mode 1. In a case where the apparatus is not transported, the locking of the carriage may not be performed even in the state shown in FIG. 11A.

Here, turning off of the power includes an off state due to a power saving mode or the like in addition to a state where a main switch is turned off. Here, the power saving mode refers to states where at least any of states is executed in which power supply to a driving circuit provided in the liquid ejecting apparatus is blocked, power supply to a circuit of a detection unit is blocked, the voltage of the power supplied to these circuits is decreased, or display of a panel provided in the liquid ejecting apparatus is turned off. Moreover, the power saving mode is completely distinguished from a standby state such as print waiting, or an operation state.

Such a stopped state after Mode 1 is set in order to cause freezing of a liquid in a nozzle opening 21 to occur prior to freezing of a liquid in the manifold 100 in a case where there is liquid in the nozzle opening 21, by actively exposing the vicinity of the nozzle opening 21 to an environmental temperature. That is, if the nozzle opening 21 is not protected by the protection cap 9, the vicinity of the nozzle opening 21 and the periphery of the manifold 100 reach the same environmental temperature as each other, and when the environmental temperature reaches a freezing temperature, the liquid in the nozzle opening 21 which has a small amount of the liquid freezes first. Accordingly, destruction of a vibrating plate or the like due to an increase in the pressure caused by the freezing in the pressure generating chamber 12 is more reliably prevented. In contrast, if the liquid in the manifold 100 freezes earlier than the liquid in the nozzle opening 21, a state is caused in which the liquid in the pressure generating chamber 12 is sealed therein as shown in FIG. 10B, and there is a concern that destruction due to an increase in the pressure in the pressure generating chamber 12 may be caused.

Embodiment 2

In the above-described embodiment, the piezoelectric element 300 which is a driving element is used as a discharging unit for carrying out Mode 1. However, in the present embodiment, the suction cap 8 and the suction unit 8*a* are used as discharge units.

That is, stronger suction than that of the suction recovery is performed in a state where the suction cap 8 is closely adhered to the nozzle plate 20, or suction is performed in a state where supply of a liquid is stopped by blocking the blocking unit 5. Then, air is drawn into a pressure generating chamber 12 from the nozzle opening 21 by separating the suction cap 8 or by opening the inside of the suction cap 8 to the atmosphere.

Even in this case, some nozzle openings 21 draw air and the states shown in FIGS. 8A to 8C coexist.

In the case of the present embodiment, air can be more easily drawn from the nozzle opening 21 than in the case of Embodiment 1, but there is also a concern that foreign substances may enter the suction cap 8 from the nozzle opening 21, which is a drawback. Accordingly, Embodiment 1 is preferable based on this point.

Similarly to Embodiment 1, there is an advantage in the present embodiment in that it is unnecessary to provide any particular device such as a pump for reverse feeding of a liquid unlike in JP-A-2009-61779 shown in the related art.

Embodiment 3

In the above-described embodiment, protection of the nozzle plate using the protection cap 9 is not performed after carrying out Mode 1. However, in the present embodiment, the protection of the nozzle plate using the protection cap 9 is not performed regardless of the presence/absence of the execution of Mode 1.

That is, the printer controller which is a control unit makes the apparatus enter a power-off state or a power saving state in a state where a nozzle opening 21 is not capped by the protection cap 9 as in FIG. 11A, or makes the apparatus enter a power-off state or a power saving state in a state where a nozzle opening 21 is capped by the protection cap 9 as in FIG. 11B.

The apparatus is made to enter the power-off state or the power saving state in a state where a nozzle opening 21 is not capped by the protection cap 9 in order to make the freezing of the liquid in the nozzle opening 21 precede in a case where there is a liquid in the nozzle opening 21, by actively exposing the vicinity of the nozzle opening 21 to an environmental temperature.

As described above, the region which is capped by the protection cap 9 is a portion including a region corresponding to the entire nozzle plate 20 and at least a part of the manifold 100, on a plane along the liquid ejecting surface 20*a*. That is, in a capped state using the protection cap 9, the nozzle plate 20 and the lower part of the manifold 100 such as a compliance portion of a compliance substrate 45 are exposed to the same temperature as each other.

If freezing starts in a state where the portion from a nozzle opening 21 to the manifold 100 is filled with a liquid, freezing of a liquid in the nozzle opening 21 and freezing of a liquid in the lower portion in the manifold 100 start substantially at the same time as each other. If the freezing proceeds, a flow path on a side communicating with the nozzle opening 21 of a pressure generating chamber 12 and a flow path on a side communicating with the manifold 100 freeze. When a liquid in the pressure generating chamber 12 freezes, the apparatus enters a state where there is no place for the expansion pressure to escape, which causes destruction of a vibrating plate or the like.

However, if the apparatus enters a power-off state or a power saving state in a state where a nozzle opening 21 is not capped by the protection cap 9, the nozzle opening 21 enters a state of not being capped by the protection cap 9, and a liquid in the nozzle opening 21 which has a small amount of the liquid freezes first. In contrast, the lower portion of the manifold 100 is set to a compliance portion of the compliance substrate 45. The compliance portion has a thermal insulation structure formed of a stacked structure of SUS and the flexible sealing film 46, and also interposes an air layer. Therefore, the compliance portion has a thermal conductivity which is lower than that of the nozzle plate 20 and has a large amount of a liquid therein, and thus, the freezing is delayed. Accordingly, even in a case where freezing in a pressure generating chamber 12 is caused after the progression of the freezing of a liquid from the nozzle opening 21 side, the flow path on a side communicating with the manifold 100 is in a state of not freezing, and the increase in the pressure due to the freezing of a liquid in the pressure generating chamber 12 is absorbed on the manifold 100 side, and therefore, the destruction of a vibrating plate or the like is prevented. That is, in the present embodiment, the compliance portion is a thermal insulation member, has a thermal conductivity lower than that of the nozzle plate 20, and has a multilayer structure including SUS, the flexible sealing film 46, and an air layer. Accordingly, the freezing of the liquid in the manifold is more delayed than that of the liquid in the nozzle opening 21, and therefore, cracking in the pressure generating chamber 12 can be more reliably prevented.

Making the apparatus enter the power-off state or the power saving state in the state where the nozzle opening 21 is not capped by the protection cap 9 is performed in order to prevent cracking (hereinafter, in some cases, expressed as destruction) of a vibrating plate or the like due to increase in the pressure in the pressure generating chamber 12 caused by the freezing of the liquid in the pressure generating chamber 12 or the manifold 100, and is carried out when the environmental temperature in use is below the temperature at which a liquid freezes while moving and transporting the product in a case where the product is not in use for a long period of time. For example, making the apparatus enter the power-off state or the power saving state in the state where the nozzle opening is not capped by the protection cap is performed based on a user command 201, for example, when a user turns on a switch for selecting Mode 1. The printer controller 111 acquires external temperature information 202 from a detection unit such as a temperature sensor that measures the environmental temperature, in addition to the user command 201. Mode 1 may be carried out based on a determination of whether the apparatus is made to enter the power-off state or the power saving state in the state where the nozzle opening 21 is not capped by the protection cap 9 or in the state where the nozzle opening 21 is capped by the protection cap 9, based on the acquired external temperature information and the user command. In this manner, in either case where the execution of Mode 1 depends on the selection by a user or where the execution of Mode 1 depends on the detection result of the detection unit, it is possible to prevent the vibrating plate or the like from being destroyed, and Mode 1 is executed with high operability.

Embodiment 4

In the above-described embodiment, in the case where the apparatus is made to enter the power-off state or the power saving state in the state where the nozzle opening 21 is not capped by the protection cap 9, the locking of the carriage using the carriage lock mechanism 910 is arbitrarily performed. However, in the present embodiment, it is essential that the locking of the carriage using the carriage lock mechanism 910 is performed. That is, when the carriage moves to the position in FIG. 11A, the locking of the carriage using the carriage lock mechanism 910 is automatically carried out. In addition, the locking of the carriage using the carriage lock mechanism 910 is automatically carried out even in the case where the apparatus is made to enter the power-off state or the power saving state in the state where the nozzle opening 21 is capped by the protection cap 9 as shown in FIG. 11B.

Other points are the same as those in Embodiment 3 excluding the above-described points, and therefore, the description thereof will not be repeated.

The state of the power-off state or the power saving state may be set as a premise also in the present embodiment in the state where the nozzle opening 21 is not capped by the protection cap 9. However, it is unnecessary to set the power-off state or the power saving state as a premise. That is, in either case where the execution of the state depends on the selection by a user or where the execution of the state depends on the detection result of the detection unit, the carriage is locked by the carriage lock mechanism 910 in the state where the nozzle opening 21 is not capped by the protection cap 9 or in the state where the nozzle opening 21 is capped by the protection cap 9. Accordingly, even if the apparatus is not in the power-off state or power saving state, the freezing in the nozzle opening 21 or the pressure generating chamber 12 can progress prior to the freezing in the manifold 100, and therefore, it is possible to prevent cracking in the pressure generating chamber. In addition, the locking of the carriage using the carriage lock mechanism 910 is performed, and therefore, relative movement is prevented when moving or transporting the apparatus.

Other Embodiments

Embodiments of the invention have been described above, but the basic configuration of the invention is not limited to the above-described description.

In the above-described embodiments, the recording head having a configuration in which the communication plate 15 is provided between the flow path forming substrate 10 and the nozzle plate 20 has been exemplified, but the recording head may have a configuration in which the communication plate 15 is not provided.

Figure 12:
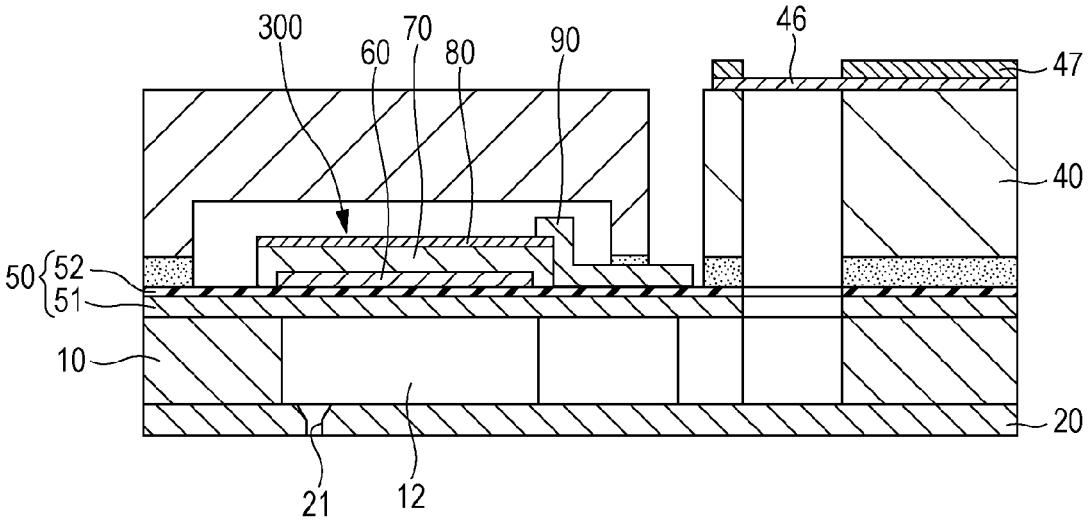
FIG. 12 is a cross-sectional view showing an example of a recording head according to another embodiment.

A configuration in which a nozzle plate 20 is directly bonded to the flow path forming substrate 10 without being provided with a communicating plate is exemplified in FIG. 12. The same members as in the above-described embodiments are given the same reference numerals and the description thereof will not be repeated.

In addition, the completion of Mode 1 may be set to occur at a point in time when air is drawn into all of the pressure generating chambers 12. Accordingly, even if the temperature is at a temperature at which a liquid freezes after all of the pressure generating chambers 12 are filled with the air, destruction of a vibrating plate or the like due to the freezing of the pressure generating chambers 12 is prevented.

In addition, in the above-described ink jet recording apparatus I of Embodiment 1, an example in which the ink jet recording head II (head unit 1) is mounted on the carriage 2 and moves in the main scanning direction has been exemplified, but the invention is not particularly limited thereto. For example, it is also possible to apply the invention to a so-called line type recording apparatus in which the ink jet recording head II is fixed and printing is performed by simply moving a recording sheet S such as paper in the sub-scanning direction.

In addition, the above-described example of the ink jet recording apparatus I is an example in which a liquid storage unit such as an ink tank is fixed to the main body of the apparatus and the liquid storage unit and the ink jet recording head II are connected to each other through a supply tube such as a tube. However, the invention is not particularly limited thereto, and the liquid storage unit may not be mounted in the ink jet recording apparatus. In addition, the apparatus may have a configuration in which an ink cartridge which is a liquid storage unit is mounted on the carriage 2.

Furthermore, in the above-described Embodiment 1, the thin film type piezoelectric actuator 300 has been described as a pressure generating unit which causes a pressure change in the pressure generating chamber 12, but the invention is not particularly limited thereto. For example, it is possible to use a thick film type piezoelectric actuator, which is formed through a method such as pasting green sheets on each other, a vertical vibration type piezoelectric actuator, which is obtained by alternately stacking a piezoelectric material and an electrode forming material and extending the materials in the axial direction. In addition, it is possible to use an actuator in which a heating element is disposed in a pressure generating chamber as a pressure generating unit and liquid droplets are discharged through a nozzle opening due to bubbles which are generated by heat generation of the heating element, or a so-called electrostatic actuator in which static electricity is generated between a vibrating plate and an electrode, and liquid droplets are discharged through a nozzle opening using the vibrating plate deformed by the electrostatic force.

In addition, in the above-described embodiments, the ink jet recording apparatus which has the ink jet recording head has been described as an example of the liquid ejecting apparatus. However, in the invention, the entire liquid ejecting apparatus is widely set as a target, and as a matter of course, the invention can also be applied to a liquid ejecting apparatus which includes a liquid ejecting head that ejects a liquid other than an ink. Examples of other liquid ejecting heads include various recording heads which are used in an image recording apparatus such as a printer; a color material ejecting head which is used for manufacturing a color filter of a liquid crystal display or the like; an organic EL display; an electrode material ejecting head which is used for forming an electrode of a field emission display (FED) or the like; and a bio-organic ejecting head which is used for manufacturing a biochip. The invention can also be applied to a liquid ejecting apparatus provided with such liquid ejecting heads.

What is claimed is:

1. A liquid ejecting apparatus comprising:

a pressure generating chamber which communicates with a nozzle and is used for discharging a liquid in the pressure generating chamber through the nozzle through pressure fluctuation caused by driving a driving element;

a manifold which communicates with the pressure generating chamber and supplies a liquid to the pressure generating chamber;

a discharge unit configured to discharge a liquid in the pressure generating chamber through the nozzle; and a control unit for discharging a liquid through the nozzle by selecting Mode 1 or Mode 2, wherein Mode 1 is a mode in which a liquid in the pressure generating chamber is discharged through the nozzle such that air is drawn into a flow path from the pressure generating chamber through the manifold due to the operation of the discharge unit and a meniscus is formed in the flow path, and wherein Mode 2 is a mode in which the driving element is driven such that air is not drawn into the pressure generating chamber through the nozzle due to the driving of the driving element.

2. A The liquid ejecting apparatus according to claim 1, wherein the nozzle includes a first nozzle and a second nozzle, and wherein Mode 1 is a mode in which air is drawn into the manifold through the first nozzle, air is not drawn through the second nozzle, and the air in the manifold which is drawn through the first nozzle forms a meniscus in a flow path between the manifold and a pressure generating chamber which communicates with the second nozzle.

3. A The liquid ejecting apparatus according to claim 1, further comprising:

a blocking unit which blocks the flow path in the middle of the flow path through which a liquid is supplied to the manifold, wherein Mode 1 is performed in a state where the flow path is blocked by the blocking unit.

4. A The liquid ejecting apparatus according to claim 1, wherein the discharge unit is the driving element, and wherein Mode 1 is a mode in which the driving element is driven such that air is drawn into the pressure generating chamber through the nozzle due to the driving of the driving element.

5. A The liquid ejecting apparatus according to claim 4, wherein the manifold communicates with a plurality of pressure generating chambers and supplies a liquid to the plurality of pressure generating chambers, and wherein Mode 1 is a mode in which the driving element is driven such that air is drawn into the manifold through the nozzle, through at least one pressure generating chamber among the plurality of pressure generating chambers, due to the driving of the driving element.

6. A The liquid ejecting apparatus according to claim 4, wherein the period of a driving signal which drives the driving element in Mode 1 is shorter than that of a driving signal which drives the driving element in Mode 2.

7. A The liquid ejecting apparatus according to claim 4, wherein the amplitude of a driving signal which drives the driving element in Mode 1 is larger than that of a driving signal which drives the driving element in Mode 2.

8. A The liquid ejecting apparatus according to claim 1, further comprising:

a maintenance unit which discharges air in the pressure generating chamber through the nozzle; and a movement unit which relatively moves a medium to be discharged and the nozzle, wherein the control unit (1) can operate the maintenance unit in Mode 3, (2) relatively moves the medium to be discharged and the nozzle using the movement unit and drives the driving element such that air is not drawn into the pressure generating chamber through the nozzle due to the driving of the driving element, in Mode 2, and (3) Mode 2 is not performed until air in the pressure generating chamber is discharged in Mode 3 after drawing the air into the pressure generating chamber through the nozzle in Mode 1.

9. A The liquid ejecting apparatus according to claim 1, wherein the control unit performs Mode 1 based on the selection by a user whether to perform Mode 1.

10. A The liquid ejecting apparatus according to claim 1, further comprising:

a detection unit which detects a temperature, wherein the control unit performs Mode 1 based on a detection result of the detection unit.

11. A method of controlling a liquid ejecting apparatus which includes a pressure generating chamber which communicates with a nozzle and is used for discharging a liquid in the pressure generating chamber through the nozzle through pressure fluctuation caused by driving of a driving element, a manifold which communicates with the pressure generating chamber and supplies a liquid to the pressure generating chamber, and a discharge unit configured to discharge a liquid in the pressure generating chamber through the nozzle, the method comprising:

controlling the apparatus so as to discharge a liquid through the nozzle by selecting Mode 1 or Mode 2, wherein Mode 1 is a mode in which a liquid in the pressure generating chamber is discharged through the nozzle such that air is drawn into a flow path from the pressure generating chamber through the manifold due to the operation of the discharge unit and a meniscus is formed in the flow path, and wherein Mode 2 is a mode in which a driving element is driven such that air is not drawn into the pressure generating chamber through the nozzle due to the driving of the driving element.

12. A liquid ejecting apparatus comprising:

a nozzle plate in which a nozzle is formed;

a pressure generating chamber which communicates with the nozzle and is used for discharging a liquid within the pressure generating chamber through the nozzle by pressure fluctuation caused by driving a driving element;

a manifold which communicates with the pressure generating chamber and supplies a liquid to the pressure generating chamber;

a cap unit for capping the nozzle; and a control unit configured to operate the cap unit by selecting Mode 1 or 2, wherein a region which is capped by the cap unit includes a region corresponding to at least a part of the manifold on a plane along the surface of the nozzle plate, wherein Mode 1 is a mode in which the apparatus enters a power-off state or a power saving state in a state where the nozzle is not capped by the cap unit, and wherein Mode 2 is a mode in which the apparatus enters a power-off state or a power saving state in a state where the nozzle is capped by the cap unit.

13. The liquid ejecting apparatus according to claim 12, further comprising:

a thermal insulation member which is fixed to a member that regulates the manifold, wherein the thermal insulation member has a thermal conductivity which is lower than that of the nozzle plate.

14. The liquid ejecting apparatus according to claim 13, wherein the thermal insulation member has a multilayer structure which includes an air layer.

15. The liquid ejecting apparatus according to claim 12, wherein the control unit performs Mode 1 based on the selection of a user of whether to perform Mode 1.

16. The liquid ejecting apparatus according to claim 12, further comprising:

a detection unit which detects a temperature, wherein the control unit performs Mode 1 based on a detection result of the detection unit.

17. A liquid ejecting apparatus comprising:

a nozzle plate in which a nozzle is formed;

a pressure generating chamber which communicates with the nozzle and is used for discharging a liquid within the pressure generating chamber through the nozzle through pressure fluctuation caused by driving of a driving element;

a manifold which communicates with the pressure generating chamber and supplies a liquid to the pressure generating chamber;

a cap unit for capping the nozzle;

a movement mechanism configured to move the nozzle relative to a medium to be discharged;

a regulating unit configured to regulate the movement of the nozzle relative to the medium to be discharged; and a control unit configured to operate the cap unit by selecting Mode 1 or 2, wherein a region which is capped by the cap unit includes a region corresponding to at least a part of the manifold on a plane along the surface of the nozzle plate, wherein Mode 1 is a mode in which the relative movement of the nozzle is regulated by the regulating unit in a state where the nozzle is not capped by the cap unit, and wherein Mode 2 is a mode in which the relative movement of the nozzle is regulated by the regulating unit in a state where the nozzle is capped by the cap unit.

18. The liquid ejecting apparatus according to claim 17, further comprising:

a thermal insulation member which is fixed to a member that regulates the manifold, wherein the thermal insulation member has a thermal conductivity which is lower than that of the nozzle plate.

19. The liquid ejecting apparatus according to claim 18, wherein the thermal insulation member has a multilayer structure which includes an air layer.

20. The liquid ejecting apparatus according to claim 17, wherein the control unit performs Mode 1 based on the selection of a user of whether to perform Mode 1.

* * * * *